US011760452B2

(12) United States Patent
Lucas

(10) Patent No.: US 11,760,452 B2
(45) Date of Patent: Sep. 19, 2023

(54) TRAINING MASK FOR TRAINING THE RESPIRATORY MUSCLES AND/OR SNORKELING MASK WITH IMPROVED AIR ROUTING

(71) Applicant: Thierry Lucas, Langenargen (DE)

(72) Inventor: Thierry Lucas, Langenargen (DE)

( * ) Notice: Subject to any disclaimer, the term of this patent is extended or adjusted under 35 U.S.C. 154(b) by 297 days.

(21) Appl. No.: 17/105,715

(22) Filed: Nov. 27, 2020

(65) Prior Publication Data

US 2021/0155328 A1 May 27, 2021

(30) Foreign Application Priority Data

Nov. 27, 2019 (EP) ..... 19211714

(51) Int. Cl.
*B63C 11/16* (2006.01)
*B63C 11/14* (2006.01)

(52) U.S. Cl.
CPC ..... *B63C 11/16* (2013.01); *B63C 11/14* (2013.01); *B63C 2011/165* (2013.01)

(58) Field of Classification Search
CPC ..... B63C 11/00; B63C 11/02; B63C 11/12; B63C 11/16; B63C 11/18; B63C 11/20; B63C 11/205; B63C 11/207; B63C 2011/125; B63C 2011/165; B63C 2011/182; A62B 9/02; A62B 18/00; A62B 18/02; A62B 18/025; A62B 18/10
See application file for complete search history.

(56) References Cited

U.S. PATENT DOCUMENTS

| | | | | |
|---|---|---|---|---|
| D335,322 | S | 5/1993 | Jones | |
| 10,625,102 | B1 * | 4/2020 | Chen | A62B 18/10 |
| 10,793,240 | B1 * | 10/2020 | Tong | B63C 11/205 |
| 10,870,470 | B2 | 12/2020 | Ocklenburg et al. | |
| 2001/0013346 | A1 * | 8/2001 | Lemke | B63C 11/16 128/201.11 |
| 2008/0196726 | A1 | 8/2008 | Brown et al. | |
| 2016/0129287 | A1 * | 5/2016 | Danford | A62B 23/025 128/863 |
| 2016/0297505 | A1 | 10/2016 | Caprice et al. | |
| 2018/0296876 | A1 * | 10/2018 | Wenger | A63B 23/18 |
| 2019/0118917 | A1 * | 4/2019 | Xiao | B63C 11/16 |
| 2019/0118918 | A1 | 4/2019 | Xiao | |
| 2019/0225312 | A1 | 7/2019 | Barone et al. | |
| 2019/0359303 | A1 * | 11/2019 | Shiue | B63C 11/12 |
| 2020/0031441 | A1 * | 1/2020 | YiHong | B63C 11/16 |
| 2020/0108218 | A1 * | 4/2020 | Bock-Aronson | A62B 18/025 |
| 2020/0130792 | A1 * | 4/2020 | Huang | B63C 11/16 |
| 2020/0189700 | A1 * | 6/2020 | Vaccaro | B63C 11/16 |
| 2021/0086882 | A1 * | 3/2021 | Grimaldi | A63B 33/00 |

FOREIGN PATENT DOCUMENTS

| | | | |
|---|---|---|---|
| WO | 2016/102522 | A2 | 6/2016 |
| WO | 2017214645 | A1 | 12/2017 |

* cited by examiner

*Primary Examiner* — Colin W Stuart
(74) *Attorney, Agent, or Firm* — BROWDY AND NEIMARK, P.L.L.C.

(57) ABSTRACT

A training mask for the training of the respiratory muscles and/or snorkeling mask with improved air routing of the inhaled and/or exhaled air includes a half mask (8) sealingly closing the mouth and nose area, wherein an air-conducting channel connector (15, 40) with hollow profile is arranged in front of the half mask (8), via which connector at least the inhaled air can be introduced frontally in the half mask (8) via an approximately central inflow opening (22).

15 Claims, 24 Drawing Sheets

Figure 1:
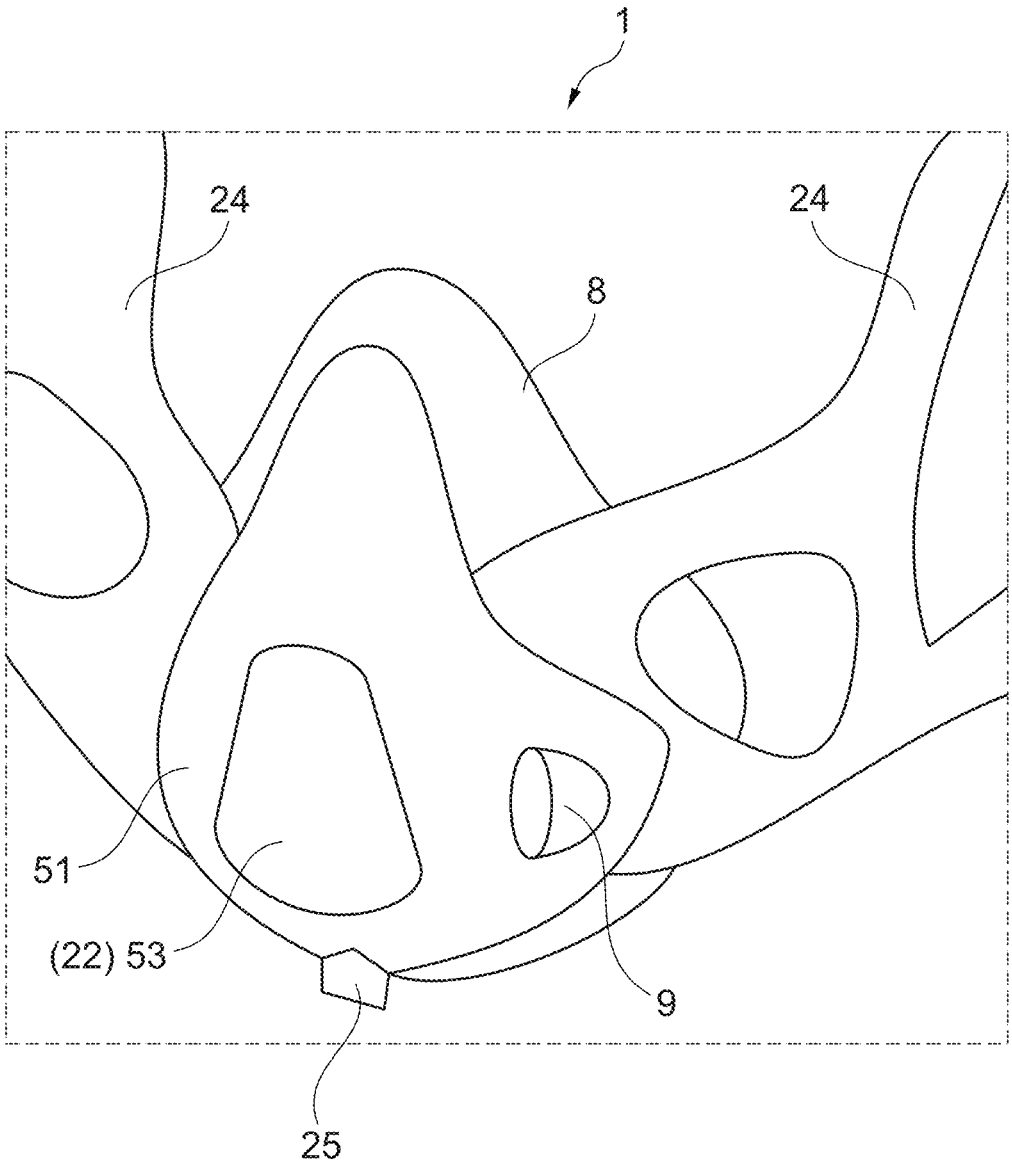

TRAINING MASK FOR TRAINING THE RESPIRATORY MUSCLES AND/OR SNORKELING MASK WITH IMPROVED AIR ROUTING

The subject matter of the invention is a training and/or snorkeling mask with improved air routing according to the preamble of claim 1.

A training mask of this type has become known, for example, with the subject matter of WO 2017/214645 A1. Said training mask is a breathing mask having a mouth and nose-covering mask body having a frontal air inlet and an also frontal air outlet provided with a check valve.

In order to create advantageous design conditions, the cited document proposes that the air inlet comprises a rotary slide valve in a seat, said seat having at least one central air inlet opening surrounding the central air outlet in sections, wherein the rotary slide valve covers the air inlet opening differently depending on its rotational position and thus enables restricting the breathing air.

With the arrangement of an air slide, a restriction of the supply air is achieved to form a stronger inhalation resistance in order to train muscles associated with inhalation and exhalation in the chest of a person in this way.

The disadvantage of the known training mask, however, is that the airways in the training mask, i.e. the supply air and the exhaust air, are not separated from each other, which means that the expelled breathing air, which is enriched with $CO_2$, is partially sucked in again in an unintentional and disadvantageous manner which reduces the oxygen content of the inhaled air.

This is associated with a lower efficiency of the training effect, because lower oxygen uptake leads to poorer physiological conditions in the person's body. This limits the possible duration of the training and its efficiency.

The invention is therefore based on the object of further developing a training or snorkeling mask of the type mentioned above in such a way that there is an improved air routing. In particular, it is to be avoided that the exhaled air combines with the inhaled air and in the manner of a short circuit, deteriorates the inhaled air with respect to the oxygen content.

In order to achieve the object set, the invention is characterized by the features of applicable claim 1.

Accordingly, the invention relates to a training mask for the training of the respiratory muscles and/or a snorkeling mask with improved air routing of the inhaled and exhaled air consisting of a half mask sealingly closing the mouth and nose area, wherein an air-conducting channel connector with hollow profile is arranged in front of the half mask (8) and the area of the mask sealed with respect to the user, via which connector at least the inhaled air can be introduced frontally in the half mask via an approximately central inflow opening.

This ensures that the inhaled air is directed directly and frontally into the mouth and nose area of the user. A lateral introduction of the inhaled air into the half mask, as is known from the prior art, is thereby avoided.

The invention is implemented in different embodiments:

1. Improvement to a training mask which is designed only for the respiratory training without water wetting and has, for this purpose, an air-restricting slide as part of an air-restricting reducing device.

2. Improvement to a snorkeling mask, which has the same properties as the training mask according to item 1, but is also equipped with one or two snorkels for training in the water.

3. Improvement to a snorkeling mask, which, however, does not have air-restricting properties like the masks according to numerals 1 and 2, which, however, has improved air routing. Due to the flow conditions which are restricted by the design in the case of snorkeling masks, such a snorkeling mask can also be used as a training mask in swim training.

4. Improvement to a snorkeling mask, which, however, does not have air-restricting properties like the masks according to numerals 1 and 2, in which, however, only the inhaled air is passed through one or more snorkels, while the exhaled air is introduced directly from the half mask into an adjoining frontal channel connector arranged in the lower area of the snorkeling mask, and is discharged, starting from the channel connector, via one or two valve-supported exhale openings which may be arranged directly laterally at a channel connector. This ensures a shortened routing of the exhaled air, because it is no longer routed via the snorkel, but is discharged into the water directly laterally in the region of the channel connector. This has the advantage that a standing air column of the exhaled air that is possibly oscillating only during exhalation is avoided in the air channel serving exhalation in the snorkel, because with this technical teaching the exhaled air can be discharged into the surrounding water by the shortest route. The exhaled air then no longer has to take the long route via the snorkel. Of course, there are valves in the area of this discharge opening which prevent water from entering the discharge openings.

This solution also helps to improve the air routing of the snorkeling mask, because the exhalation resistance for discharging the exhaled air is reduced due to the shortened length of the discharge routes.

All four versions have in common the feature of improved air routing, which consists in the fact that the inhaled air is routed separately from the exhaled air and that the inhaled air is routed directly and frontally into the mouth and nose opening without significant flow obstacles. This means that there are no significant deflections and flow-increasing flow paths for the inhaled air. The air routing is also improved by optimizing the flow paths for the exhaled air.

For the third exemplary embodiment, it is noted that even a snorkeling mask, which is not equipped with an air-restricting rotary slide valve, can achieve a training effect during the swim training, because, due to the design, the air channels routed in the interior of the snorkeling mask produce a restriction of the inhaled and/or exhaled air and thus the desired training effect of the respiratory muscles.

An advantageous feature of the invention is that the exhaled air is no longer expelled frontally at the front of the half mask, as in WO 2017/214645 A1, but the exhaled air is discharged laterally at least on one side of the half mask in a forced air flow—either directly via valve-supported lateral discharge openings or in the discharge paths of the snorkel—, so that the frontal flow of inhaled air and the lateral flow of exhaled air can no longer cross and mix.

This provides the advantage that the laterally flowing flow of exhaled air does not cross the frontally directed flow of inhaled air because the two flows are fluidically separated from each other and the flow conditions are chosen such that the flow of exhaled air no longer enters the flow of inhaled air and can no longer enrich it with CO2.

In a preferred configuration, it is therefore provided that the half mask used has two diametrically opposite, lateral discharge openings which are directed into the outside atmosphere, so that the flow of exhaled air flows laterally from the half mask over the lateral parts of the person's face and the flow of inhaled air is directed frontally from the front into the half mask.

A preferred configuration of the invention is a central and frontal air inflow opening, which is arranged in the front region of the half mask and behind which a large-area closing valve is arranged in the half mask, which allows only an inhalation, however, closes during exhalation.

Furthermore, there are two diametrically opposed, lateral discharge openings which are also closed off by valves, with all valve devices preferably being designed as smooth-running poppet valves with flexible membranes.

The valves arranged in the area of the outlet openings therefore only open under the action of the discharge air, but close when the air is sucked in via the front valve.

The given technical teaching offers the advantage that a well-defined separation of the supply and exhaust air flows is achieved through the air routing and valve assembly inside the half mask, which was not previously known.

The subject matter of WO 2017/214645 did not include a closing valve used for the inlet air. There were simple frontal supply air openings that are not supported by a valve. Only the exhaled air was associated with a poppet valve in the frontal area of the breathing mask. Thus, there is the disadvantage that the exhaled air is discharged both through the central, frontal exhalation valve and through the inhalation openings, thereby causing the aforementioned mixing of the air flows.

A rotary disk, which was connected to a rotary slide valve as part of a reducing device, was used to partially or completely close the supply air openings in order to restrict the supply air.

The discharge valve was used in this known breathing mask only for offering the possibility of exhaling when the supply air openings, which were actuated by the rotary slide valve, were closed or almost closed. Therefore, the exhalation valve was used, which only allows exhalation, but no inhalation.

In the invention, a different air routing is used because the fresh air is sucked into the half mask by means of a generously sized inhalation valve situated on the front side. When exhaling, this large-area poppet valve is closed and the exhaled air then passes only through the lateral discharge openings with valves, which again are closed during inhalation.

This results in optimal routing of the discharge and supply air flows without the flows being mixed, as is the case with the subject matter of WO 2017/214645 A1.

In a further development of the present invention, the invention claims a further embodiment in which the inhalation and exhalation paths are lengthened by at least one snorkel.

Such a training mask therefore also serves as a snorkeling mask and is intended to enable breathing training while swimming.

In this further development of the invention it is provided that the inflow and discharge openings in the half mask are valve-free and the associated valves are positioned in the one or more snorkels.

This means that there is at least one snorkel equipped with a float valve in which snorkel the inhalation and exhalation paths are routed separately from one another. In another configuration, it may also be provided that two mutually symmetrical snorkels are present, in which each of the inhaled and exhaled air is routed separately.

This exemplary embodiment thus differs from the previously mentioned exemplary embodiment of a training mask in that the first exemplary embodiment has a half mask in which the inhalation and exhalation paths are fluidically separated from one another and are not routed in one another in an air-tight manner.

The second exemplary embodiment also differs from the first exemplary embodiment in that the inhalation and exhalation paths in a snorkeling mask are routed through one or two snorkels. However, the aim is the same training effect as with a training mask.

In one configuration, it is provided that only a single snorkel is present on a snorkeling mask, but for the sake of simpler description, the following description is based on two mutually symmetrical snorkels, although the invention is not limited thereto.

This has the advantage that the training mask described above can now be used as a snorkeling mask for swimmers in water. The features of the training mask with a reducible air inlet cross section, which is controlled by a rotary slide valve, are now used for training the respiratory muscles of swimmers.

In a particular configuration it is of particular advantage of the invention that the swimmer for the first time will be put in a position to inhale and exhale with the nose, which has not been possible until now. Until now, only oral breathing was possible.

Although WO 2016/102522 A2 shows a high performance snorkel which enables only inhalation and exhalation by mouth, however, nasal breathing is not possible.

There is also no training mask shown in which the air inlet cross section could be reduced by means of a slide in order to train the respiratory muscles of the lungs.

The advantage of the second embodiment according to the invention is therefore that a training mask expanded by one or two snorkels can now also be used in the water in its design as a snorkeling mask, because it is particularly important for swimmers to have additional targeted training of the respiratory muscles while exercising.

In this case, it has been found to be advantageous that the training mask according to the invention allows inhalation through the nose because the inhaled air is preheated and filtered through the nasal breathing and is therefore inhaled into the lungs in a conditioned state, which was not previously known.

The application of a conventional training mask, as shown, for example, in WO 2017/214645 A1, to water sports is a completely new training method that was not previously known in the prior art.

It is therefore advantageous for the invention that the basic concept of the training mask is now transferred to a snorkeling mask in which the supply air opening can be closed and opened in a controlled manner in the same way and in which there is also a strict separation of the flow of inhaled air and the flow of exhaled air and in addition nasal breathing is possible.

With regard to a reducing device, the invention does not rely on the arrangement of a rotary slide valve that turns the snorkeling mask into a training mask, but it is sufficient to completely omit the rotary slide valve and still use the snorkeling mask as a training mask because due to the design-related through the relatively narrow air channels such a training effect is to be expected.

As a result, a snorkeling mask can also be used as a training mask, and this snorkeling mask dispensing with an air slide ensures an absolutely separate routing of the inhaled and the exhaled air. This was not the case with the prior art.

In the snorkeling masks according to the prior art, as known, for example, from US 2016/0297505 A1, there is the disadvantage that said snorkeling masks are hard shell masks in which manual access to the supply air and exhaust air flows in the facial area of the user is not possible.

For this reason, the invention provides in a further development that the profile space on the nose side of the half mask is designed to be elastically bendable and it is now possible for the first time to access the half mask at least in the nasal area and to press the nasal wings together in order to achieve pressure equalization under water. This option is provided for both a land-based training mask and a water-based snorkeling mask.

The possibility of pressure equalization in the area of a half mask, which is integrated in a snorkeling mask, requires a completely new air routing.

In US 2016/0297505 A1 the air routing of the inhaled air is done solely via the interior of the snorkeling mask via the local visor and via the user's face, with the inhaled air flowing through lateral inlet valves in the half mask into the space of the half mask enclosed by the nose and mouth.

Exhalation takes place with valve support via channels arranged on the edge of the visor and face seal, which allow the exhaled air to be discharges into a channel in the snorkel that is separate from the inhaled air.

The disadvantage of this arrangement is that it is a rigid snorkeling mask, in which access to the nasal wings of the user is not possible.

Here, the invention takes effect, which now provides a flexible and compressible half mask, which is formed to be flexible and compressible at least in the nose area, which requires that the air routing for the inhaled air takes place via a channel connector (air connecting piece) on the mask, which means that a channel connector (air connecting piece) is used that connects the two opposite air inlet openings and air outlet openings arranged in the half mask to one another in the interior of the snorkeling mask on the outside of the half mask.

Thus, there is the further advantage that one or more valve-supported outlet openings for discharging the exhaled air can be arranged in the channel connector, said exhaled air thus being discharged directly into the water and no longer need to be routed via the long flow paths in the peripheral area of the snorkeling mask through the snorkel. This significantly reduces the exhalation resistance. One or more valve-supported discharge openings can be provided. The one or more discharge openings can be arranged directly on the front in the center of the channel connector. In another configuration, the outlet openings can each be arranged laterally on the channel connector. In another configuration, the one or also more valve-supported discharge openings can be arranged at the bottom—centrally or laterally—at the channel connector Regardless of the required embodiment, the snorkeling mask according to the invention therefore also allows a pressure equalization in the interior of the snorkeling mask by a pressure equalization valve that is arranged in the half mask, which enables the air that is discharged under pressure from the lungs through the mouth into the half mask to be pressed into the interior of the snorkeling mask via the connecting passage openings associated with the inhaled air to counteract the water pressure acting at greater depths on the snorkeling mask from the outside and pressing the snorkeling mask undesirably to the head of the wearer.

In this way, pressure equalization can be carried out in the interior of the snorkeling mask, whereby a special type of poppet valve is used.

The subject matter of the present invention does not result only from the subject matter of the individual claims, but also from the combination of the individual patent claims with one another.

All information and features disclosed in the documents, including the abstract, in particular the spatial configuration shown in the drawings, could be claimed as being essential to the invention, provided that they are novel, individually or in combination, compared to the prior art. The use of the terms "essential" or "according to the invention" or "essential to the invention" is subjective and does not imply that the features designated in this way must necessarily be part of one or more claims.

Below, the invention is explained in more detail with reference to drawings illustrating only one embodiment. Additional features and advantages of the invention that are essential to the invention emerge from the drawings and their description.

Figure 2:
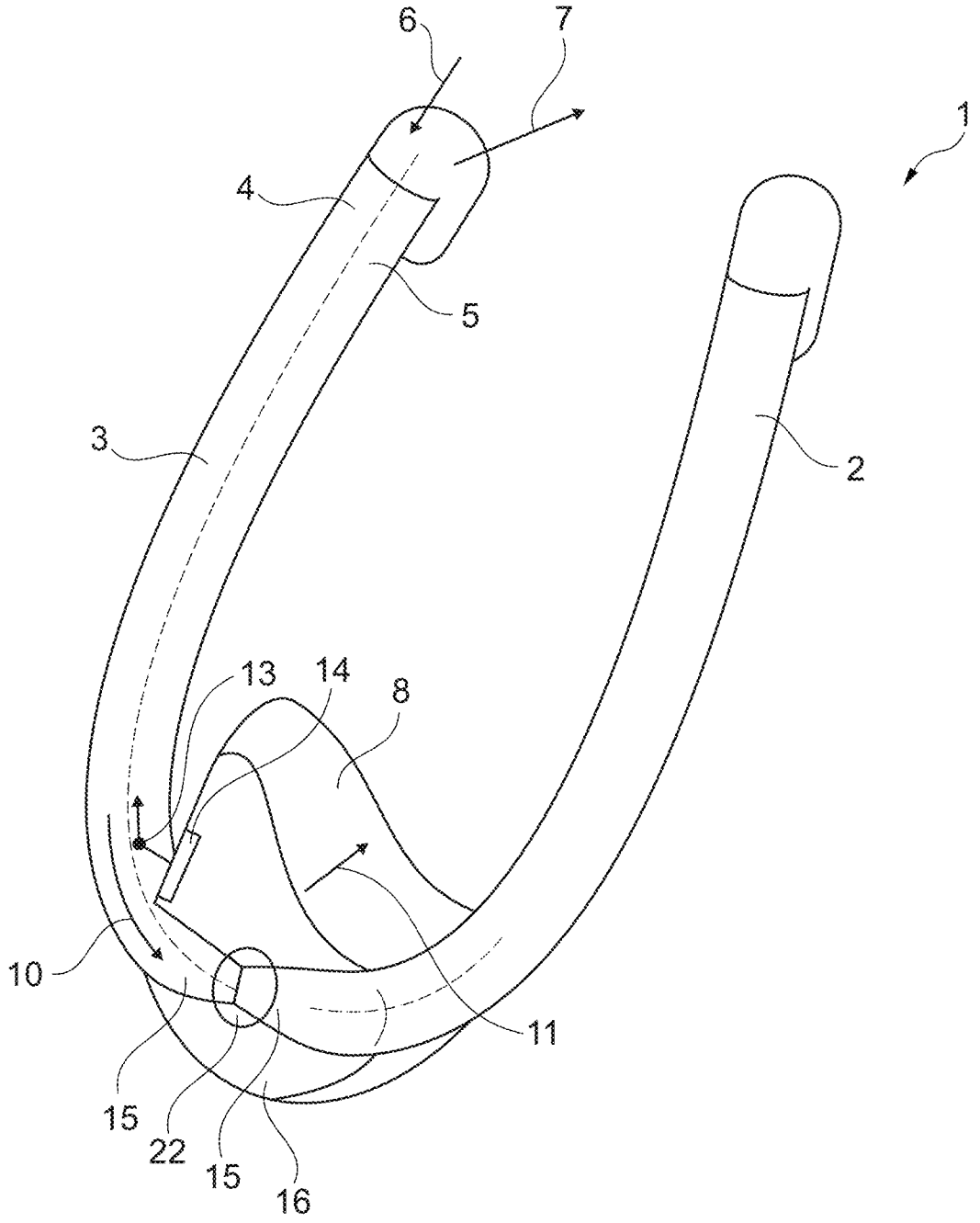
Figure 4:
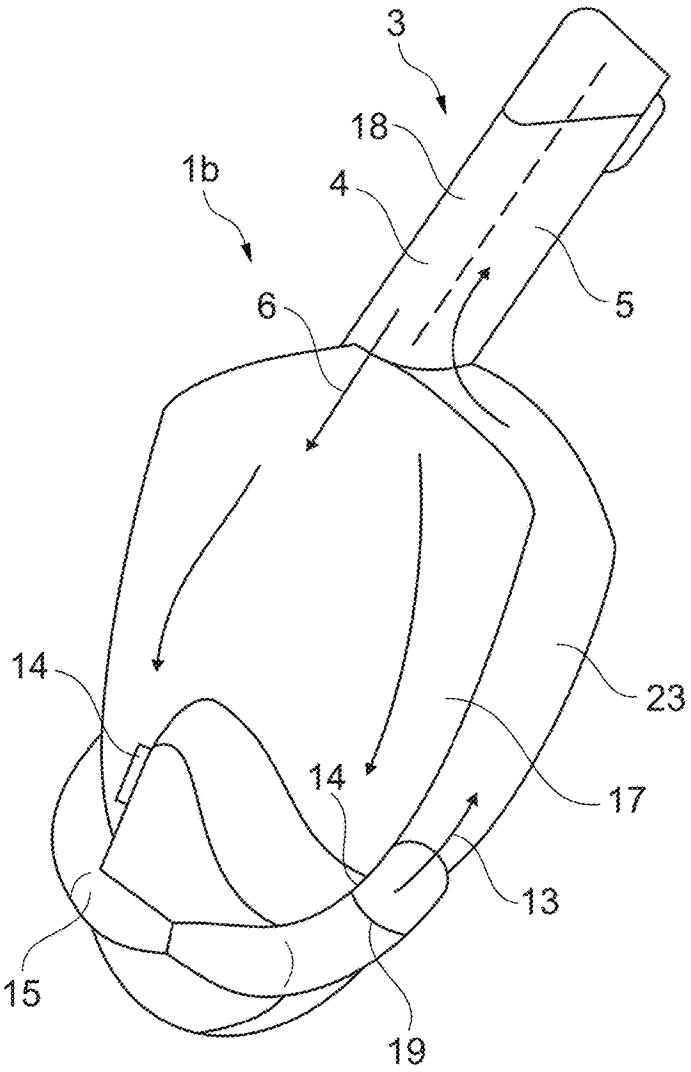
Figure 3:
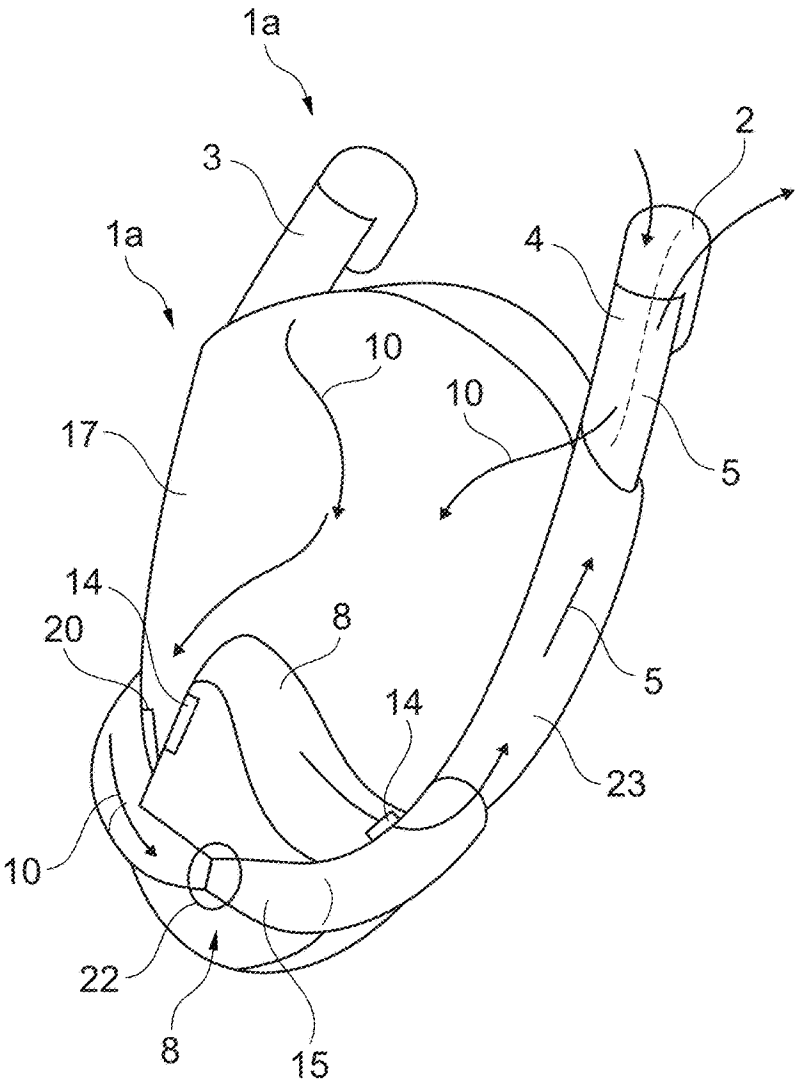

It shows:

FIG. 1: a perspective partial illustration of a training mask with a rotary slide valve FIG. 2: a perspective illustration of a training mask with snorkels FIG. 3: a modification of FIG. 2 with a training mask configured as a snorkeling mask FIG. 4: an embodiment modified in comparison with FIG. 3

Figure 5:
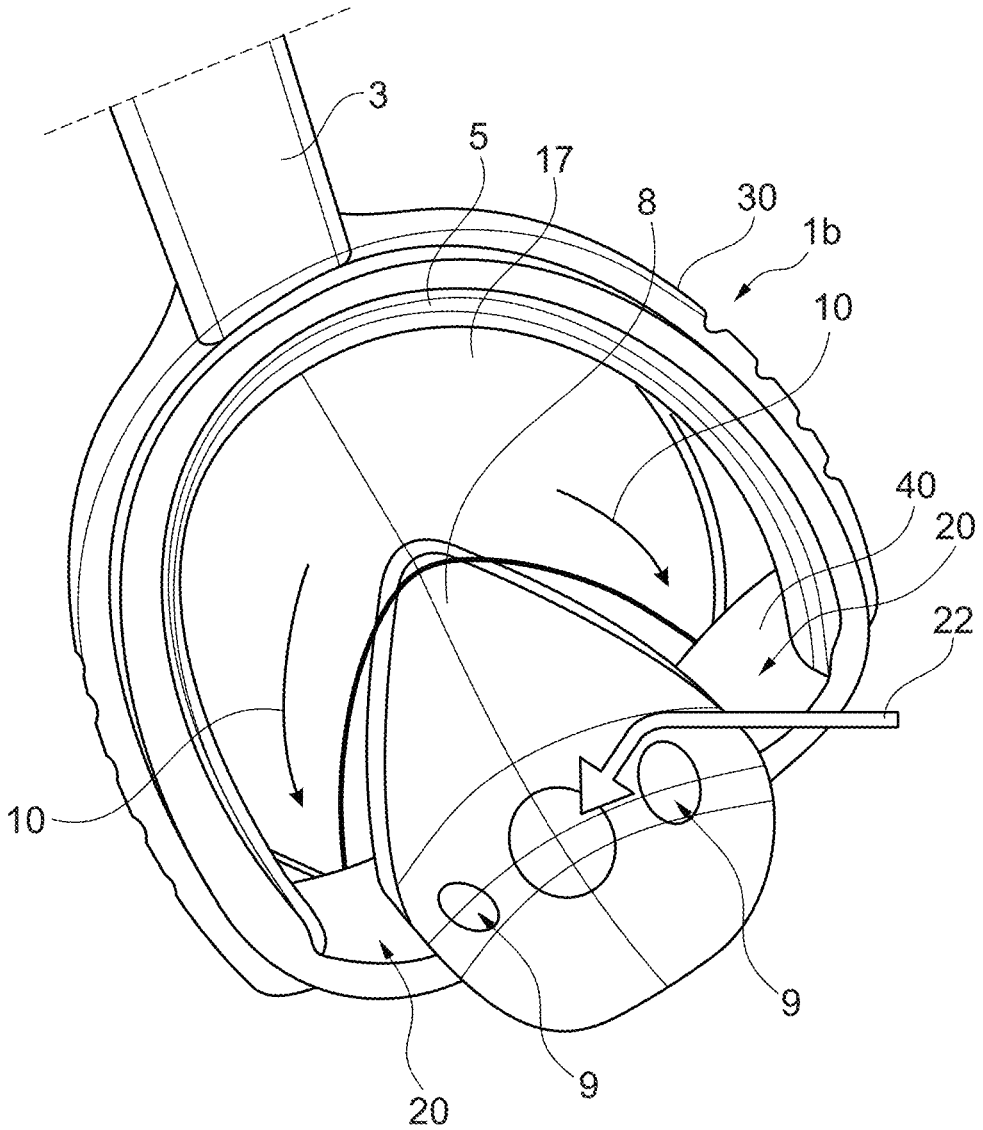

FIG. 5: the interior view of a snorkeling mask corresponding to the illustration according to FIG. 4

Figure 6:
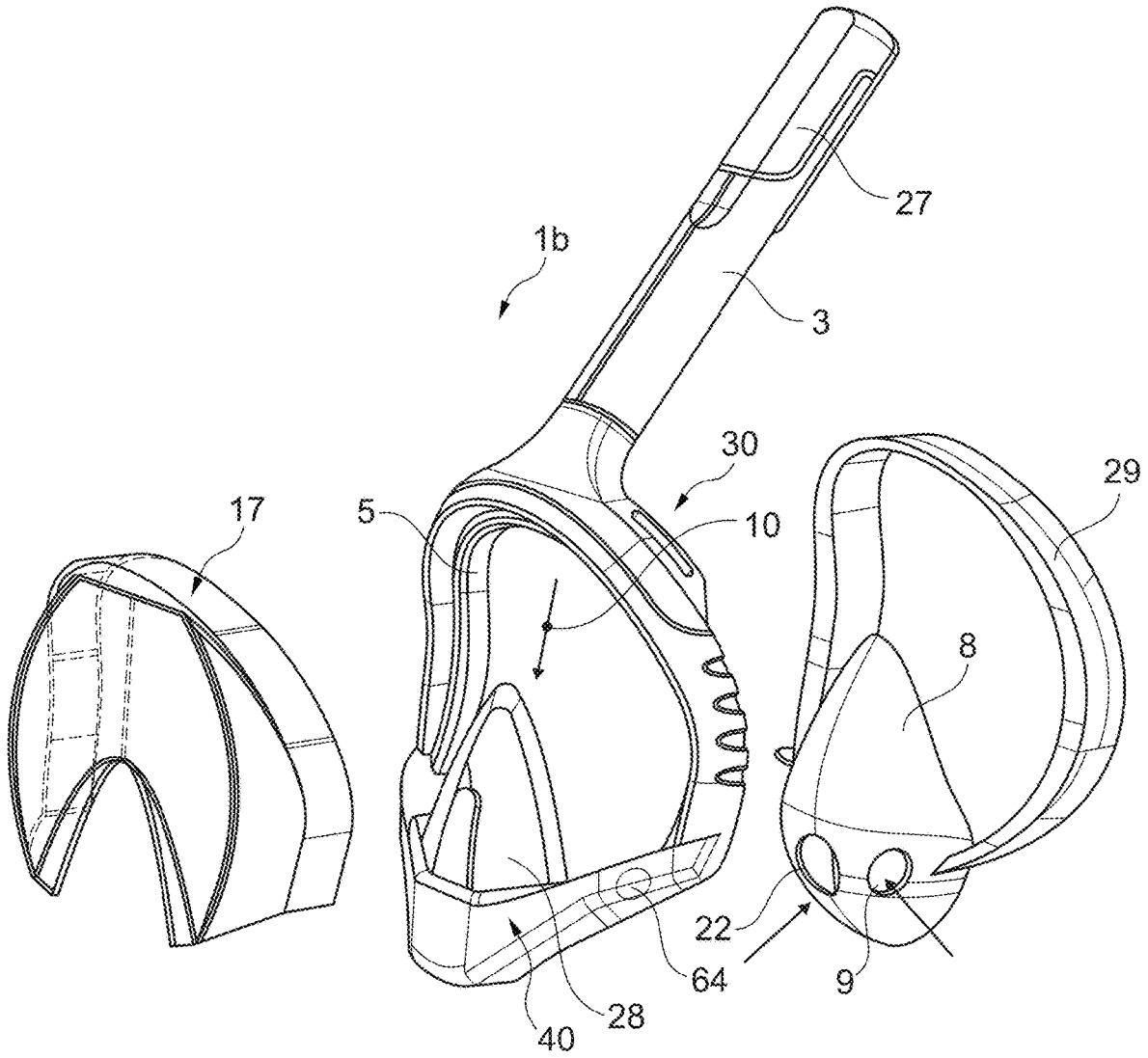

FIG. 6: a perspective, exploded illustration of the parts of the snorkeling mask according to FIG. 5

Figure 7:
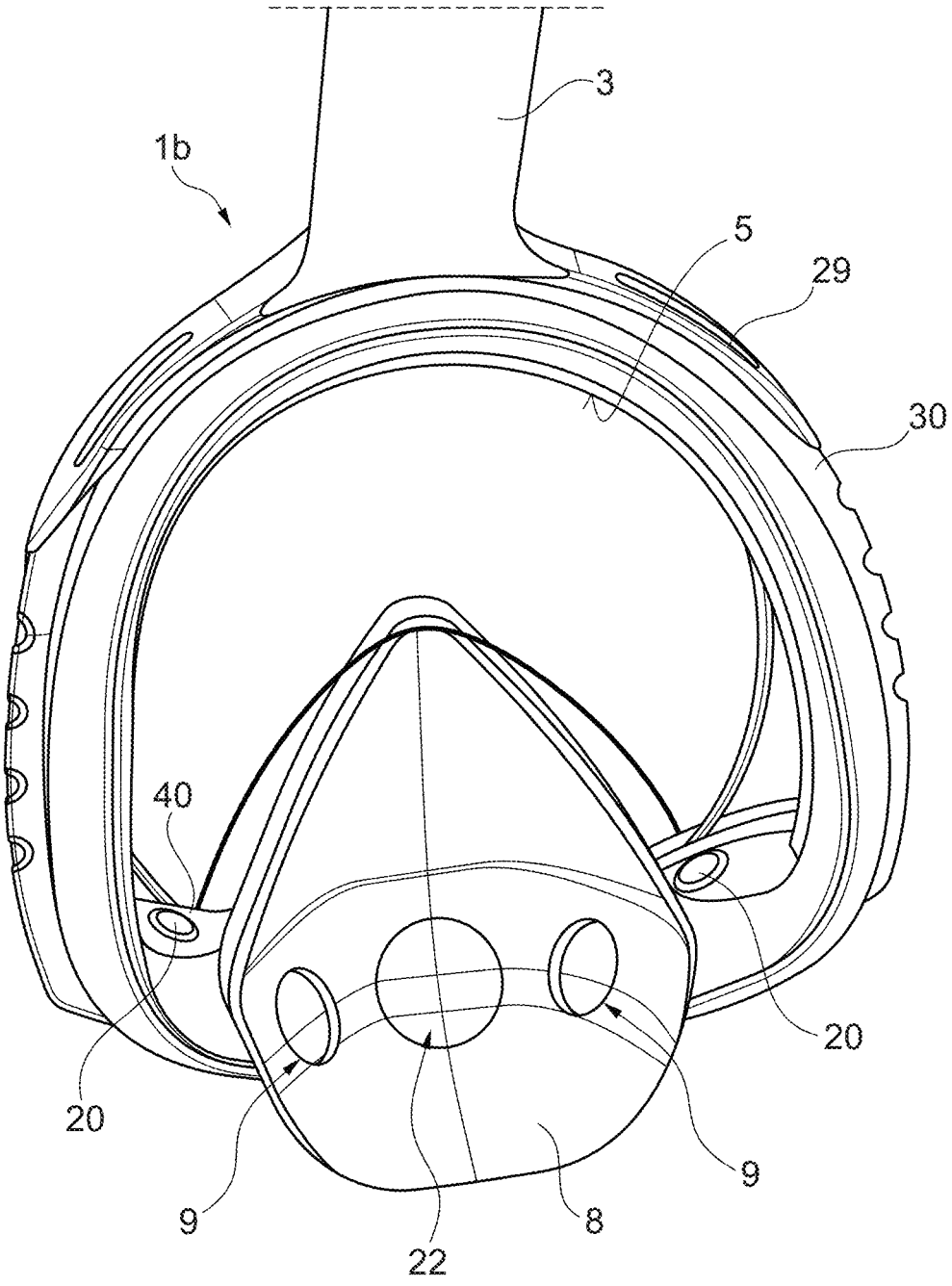

FIG. 7: an illustration similar to FIG. 5 with further details

Figure 8:
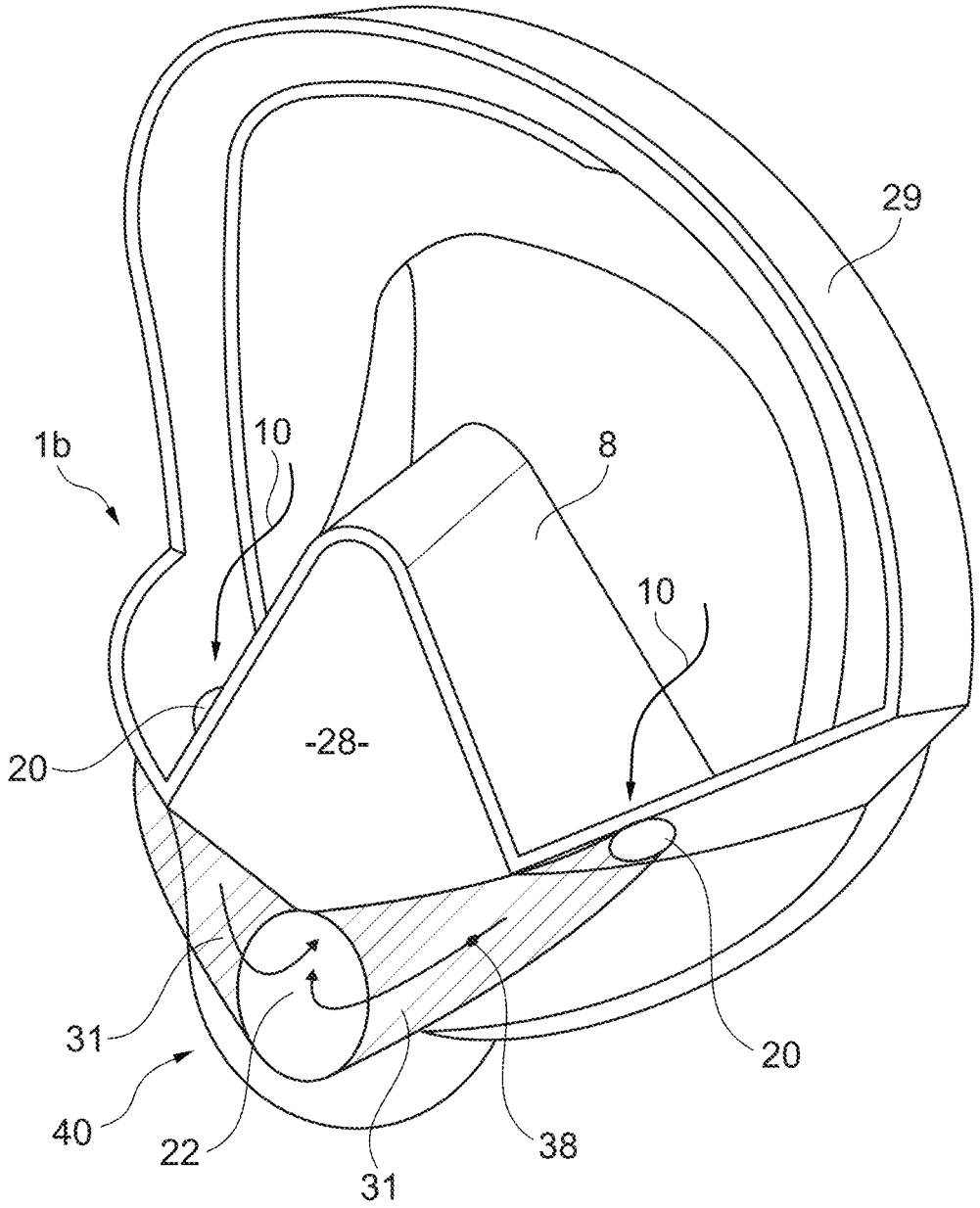
Figure 9:
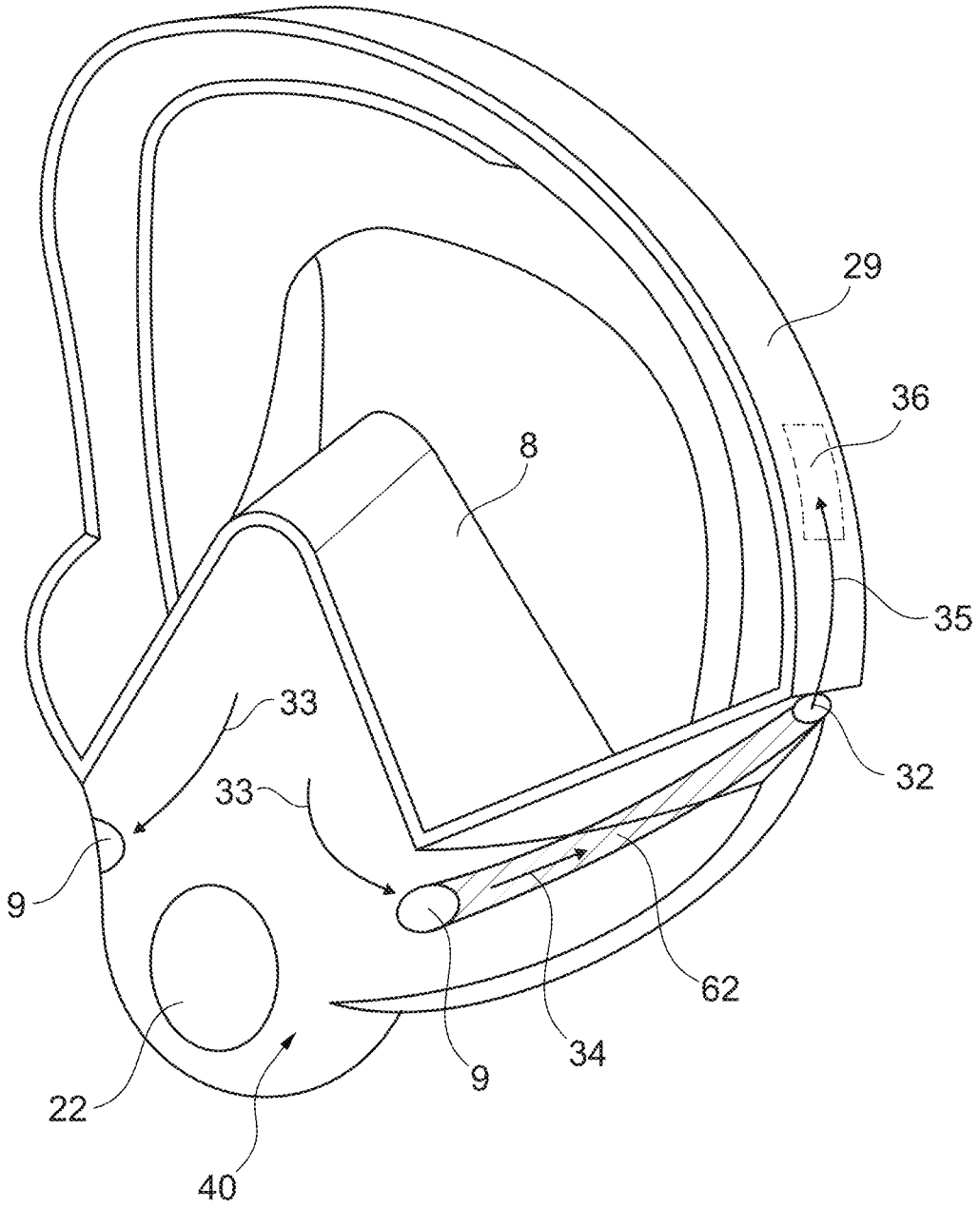

FIG. 8: the schematic illustration of the air routing for the inhaled air in a training mask FIG. 9: the schematic illustration of the exhaled air in comparison with FIG. 8

Figure 10:
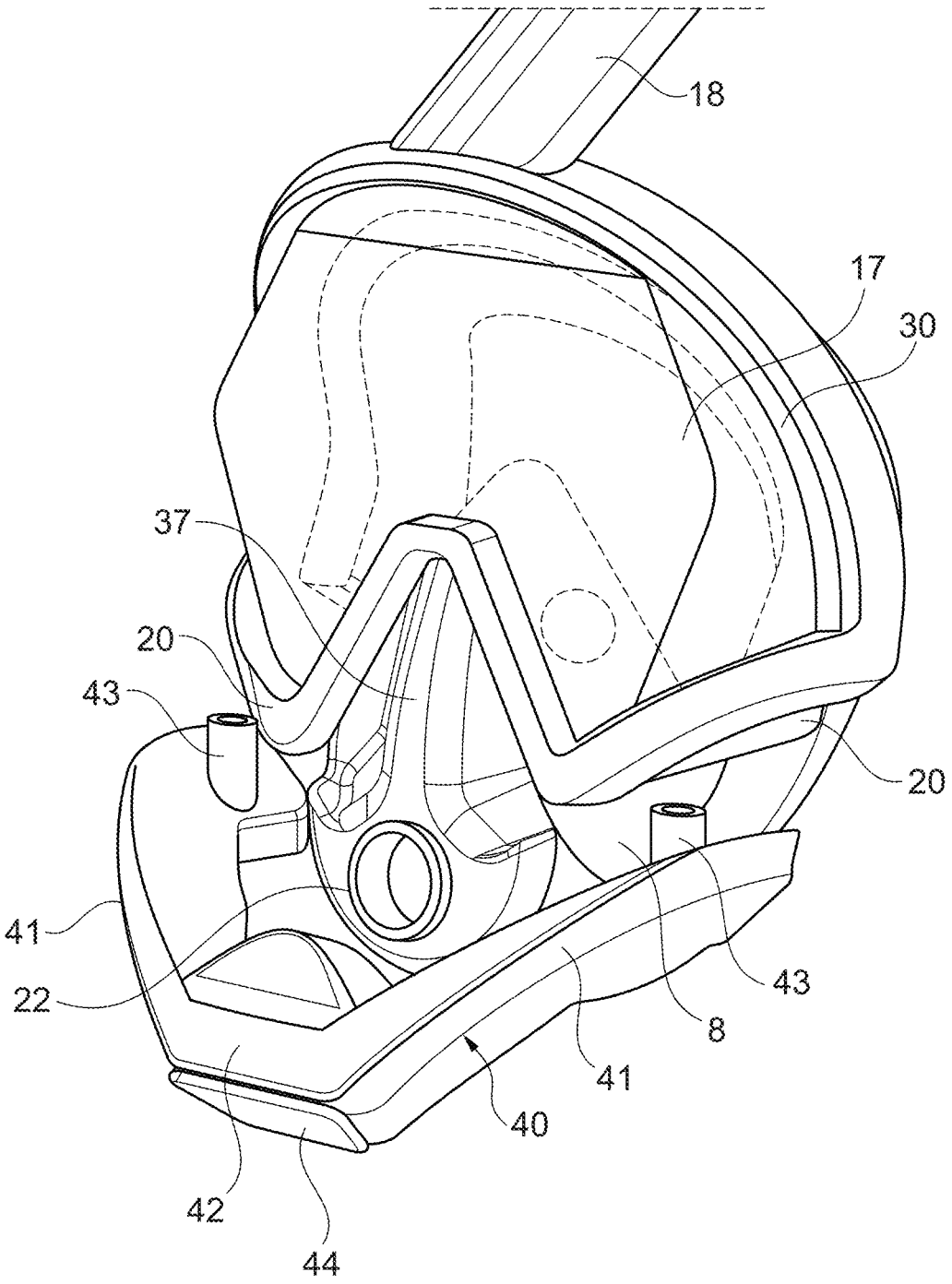
Figure 11:
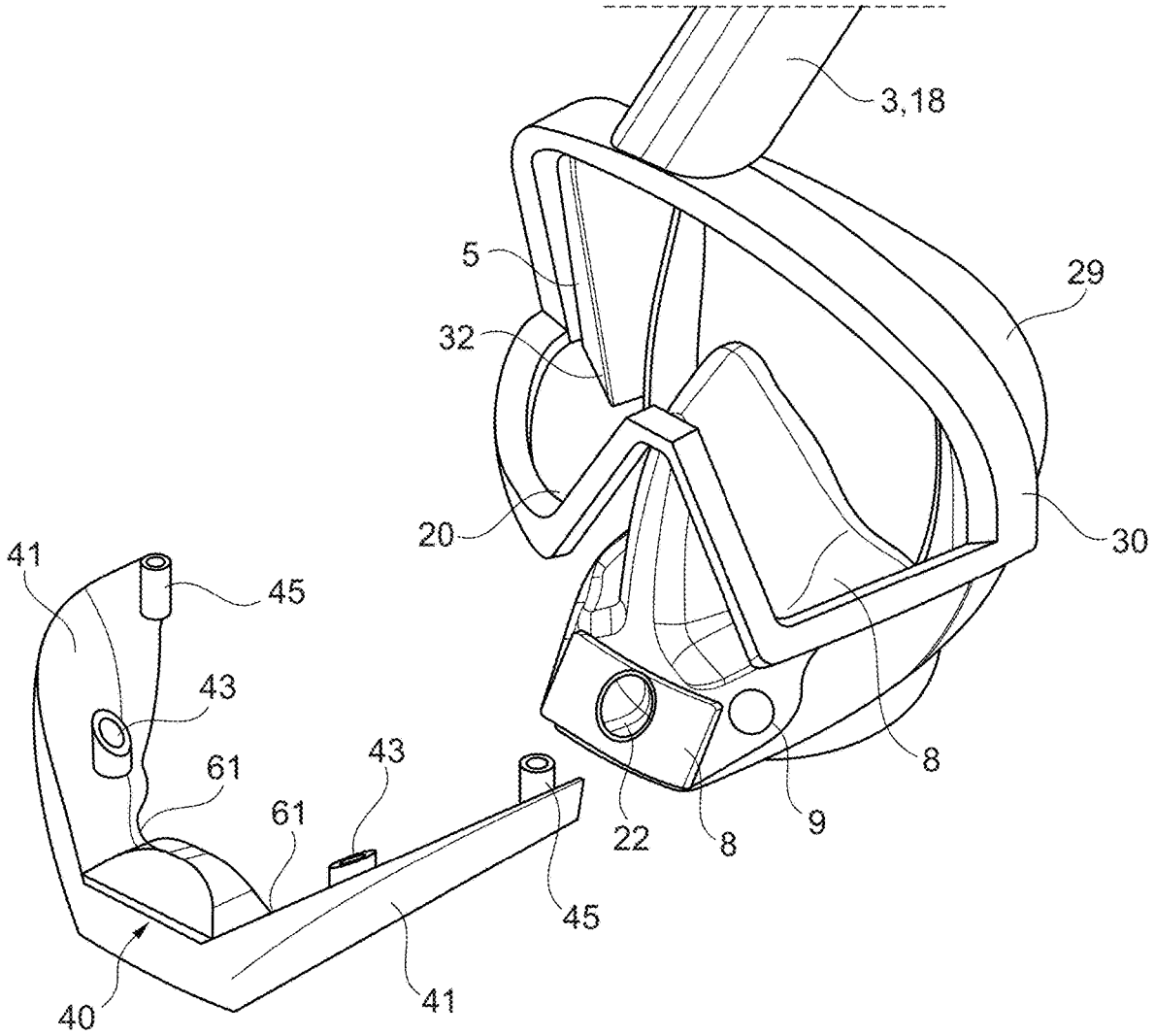
Figure 12:
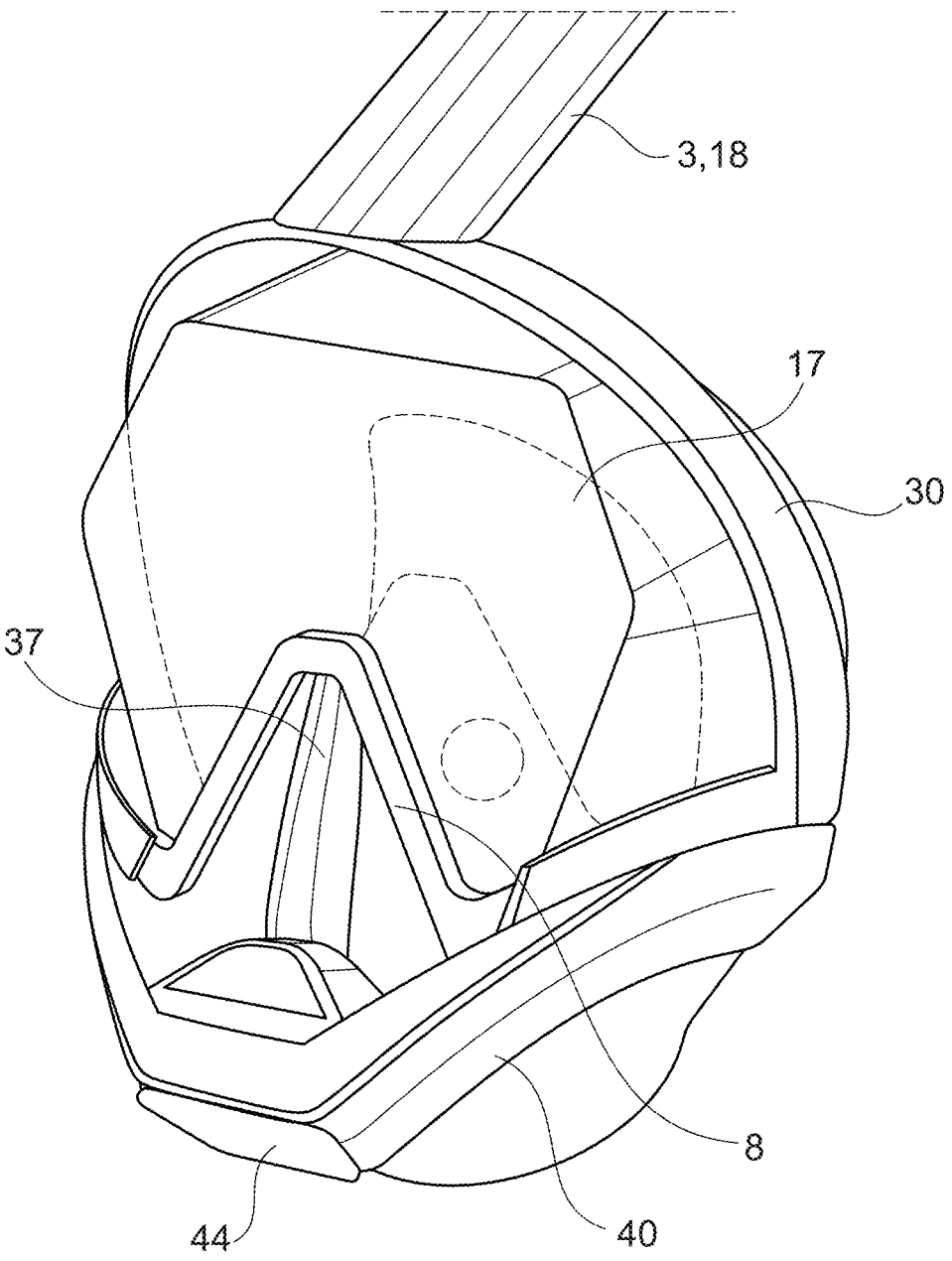

FIG. 10: an exploded illustration of a snorkeling mask with the possibility of pressure equalization in the region of the half mask FIG. 11: the same illustration as FIG. 10 with illustration of further details FIG. 12: the assembled mask according to FIGS. 10 and 11

Figure 13:
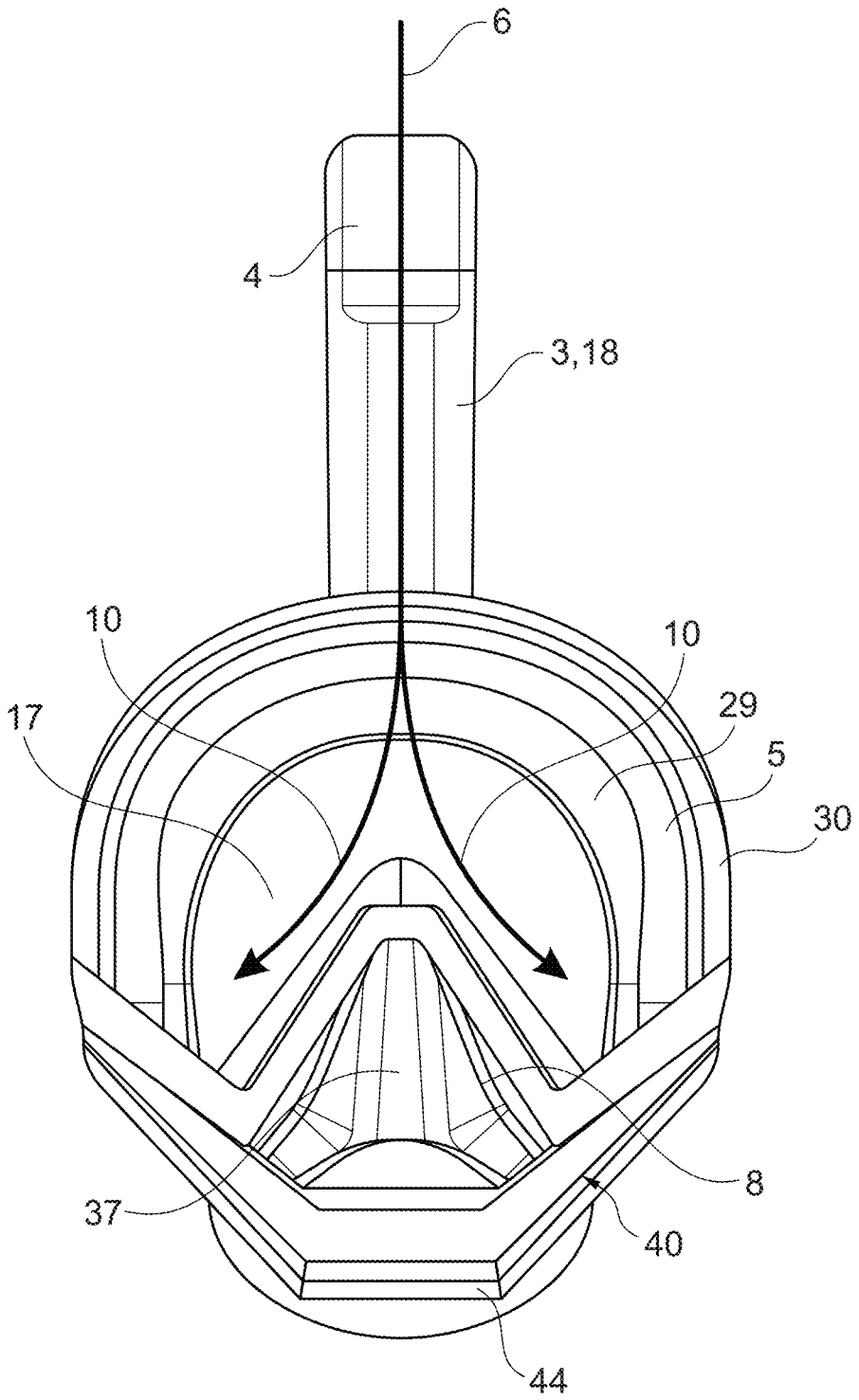

FIG. 13: schematically the air routing of the inhaled air in the snorkeling mask according to FIGS. 10 to 12

Figure 14:
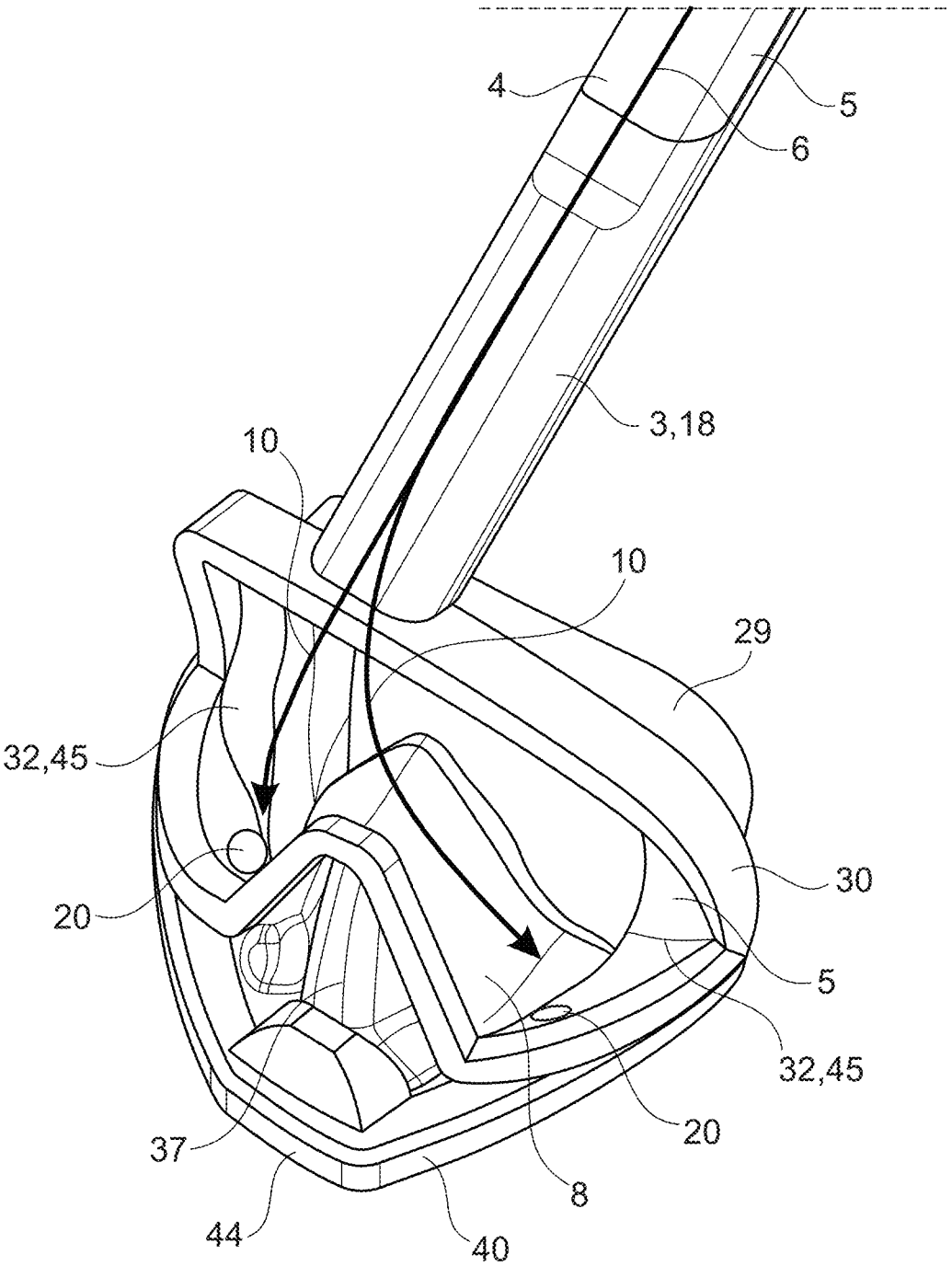

FIG. 14: a further illustration of the air routing of the inhaled air in comparison with FIG. 14

Figure 15:
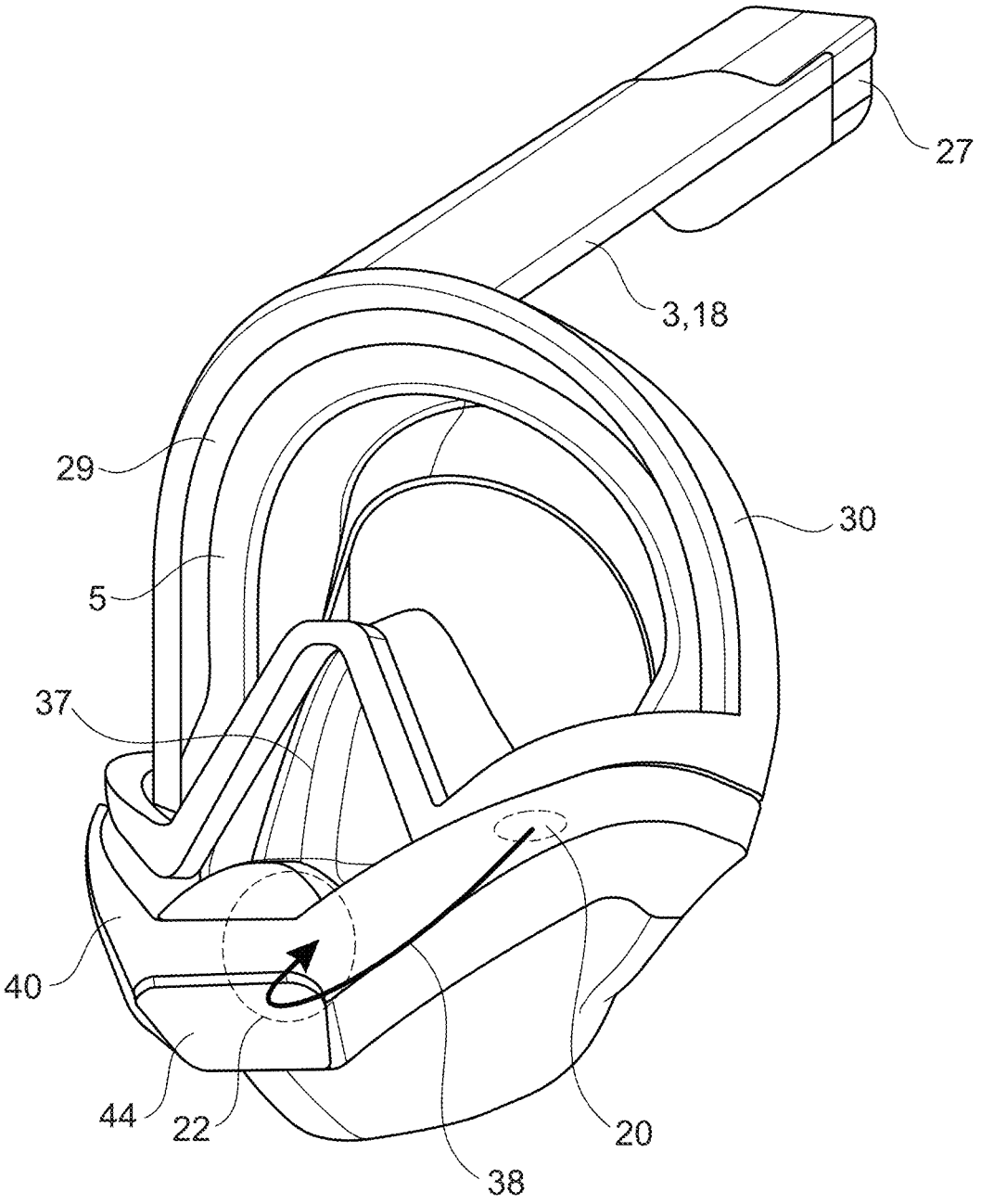
Figure 16:
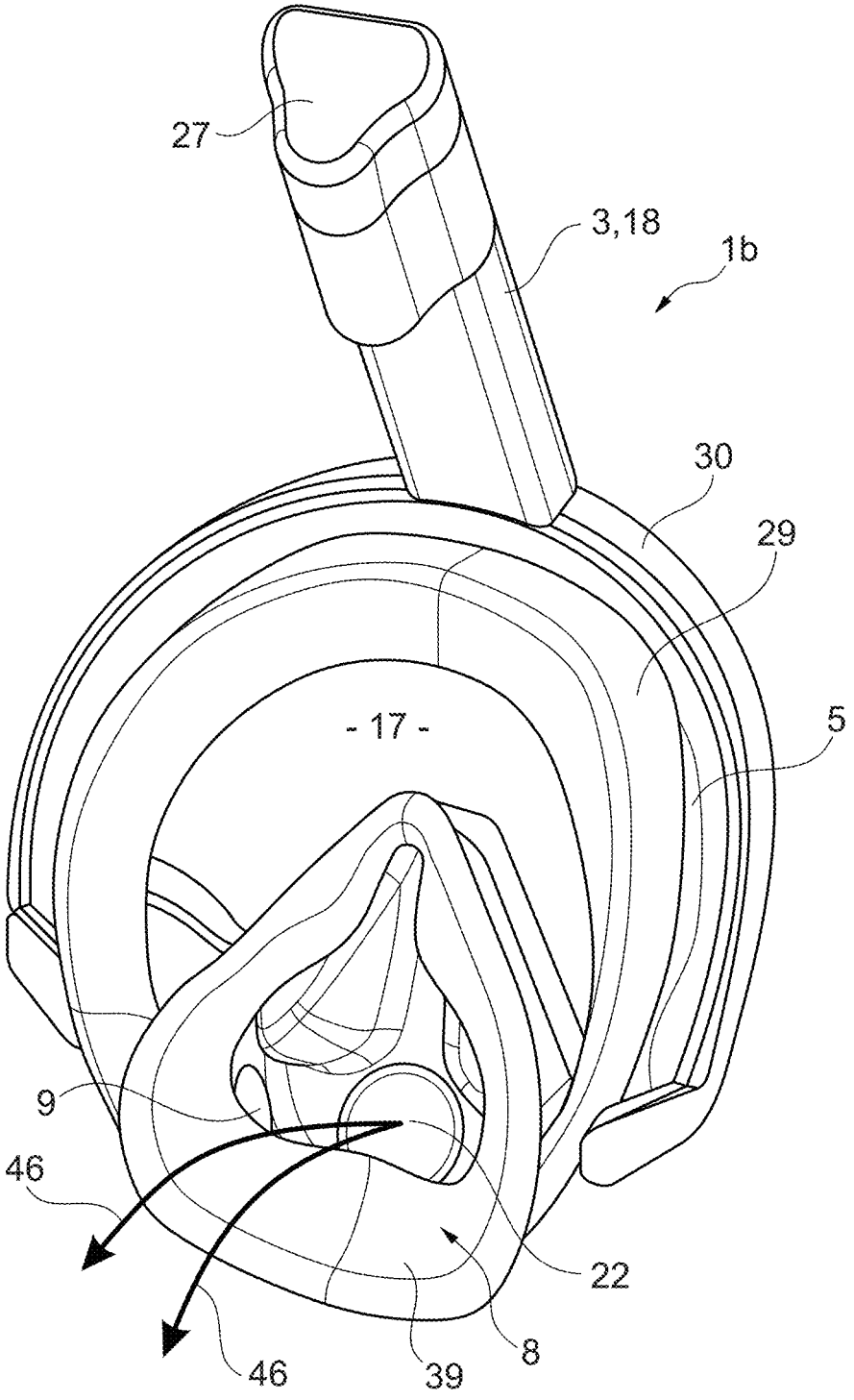
Figure 17:
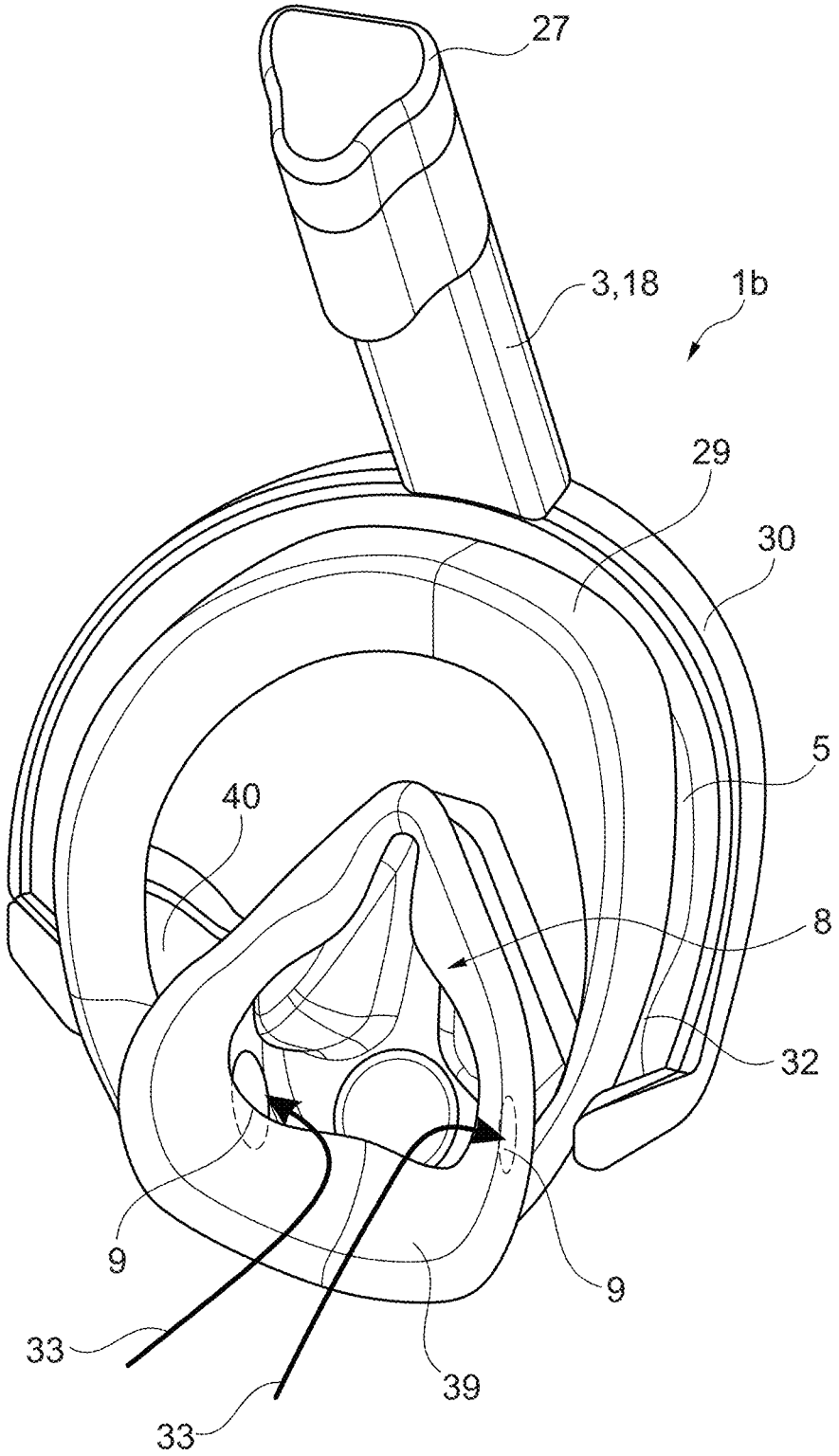
Figure 18:
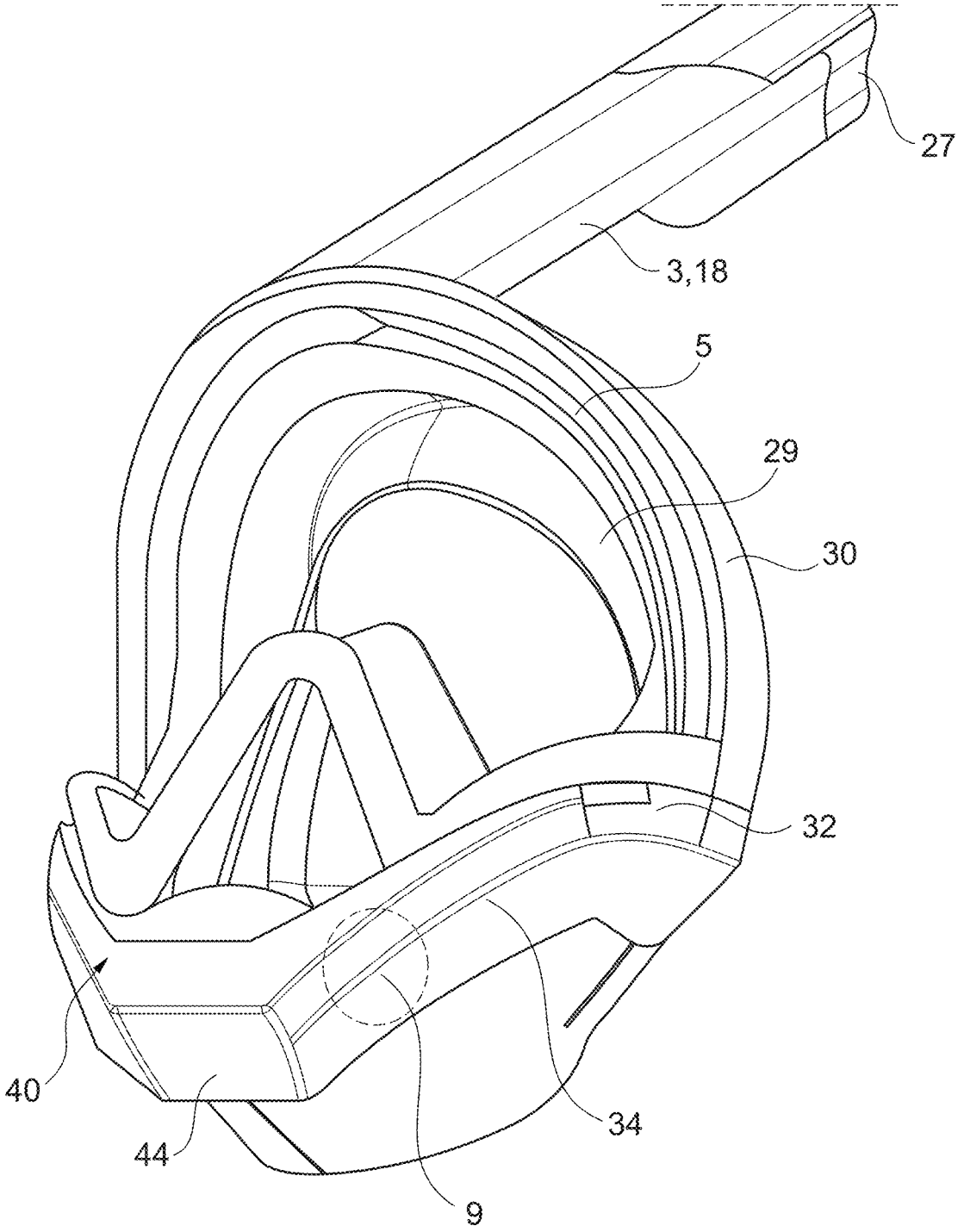
Figure 19:
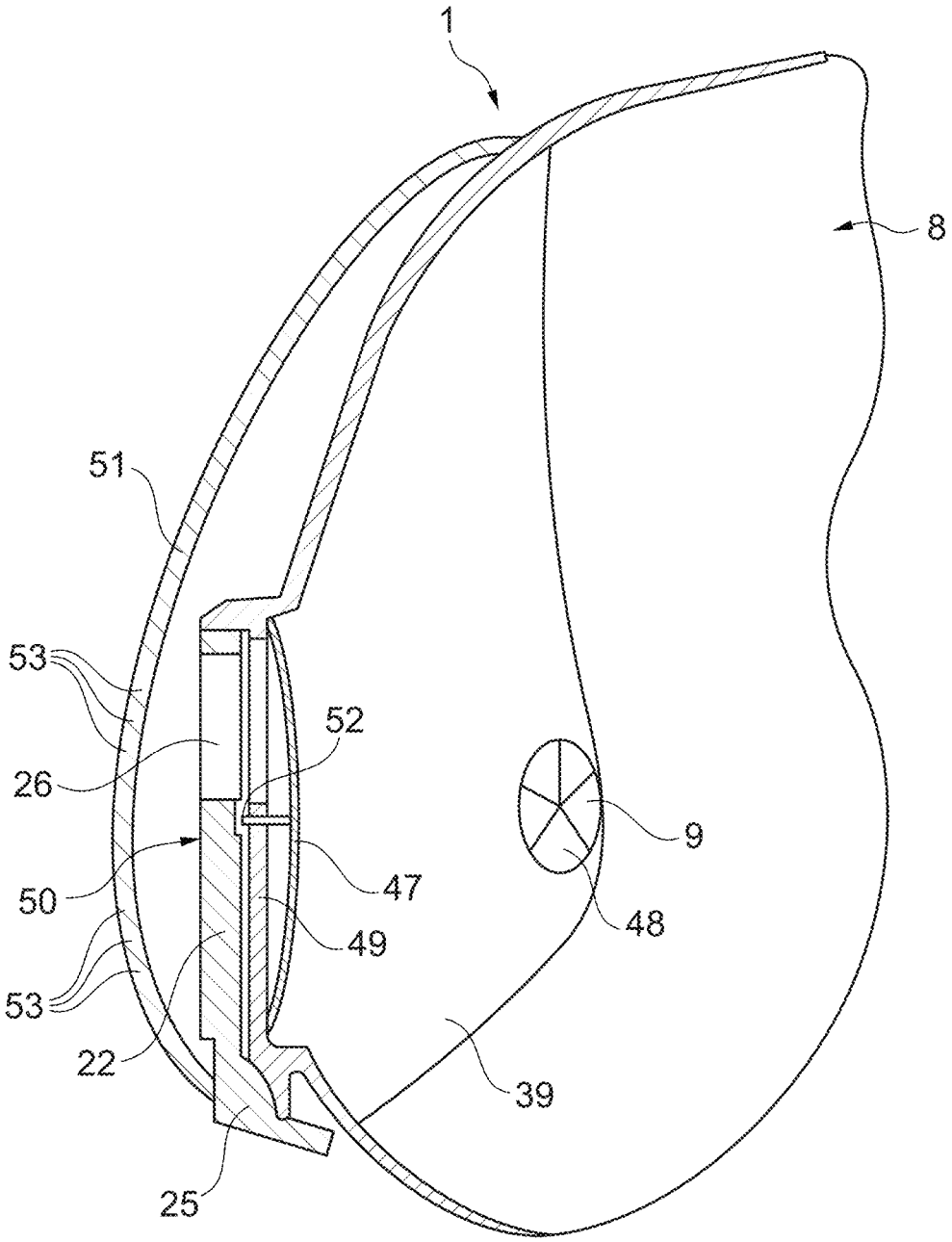
Figure 20:
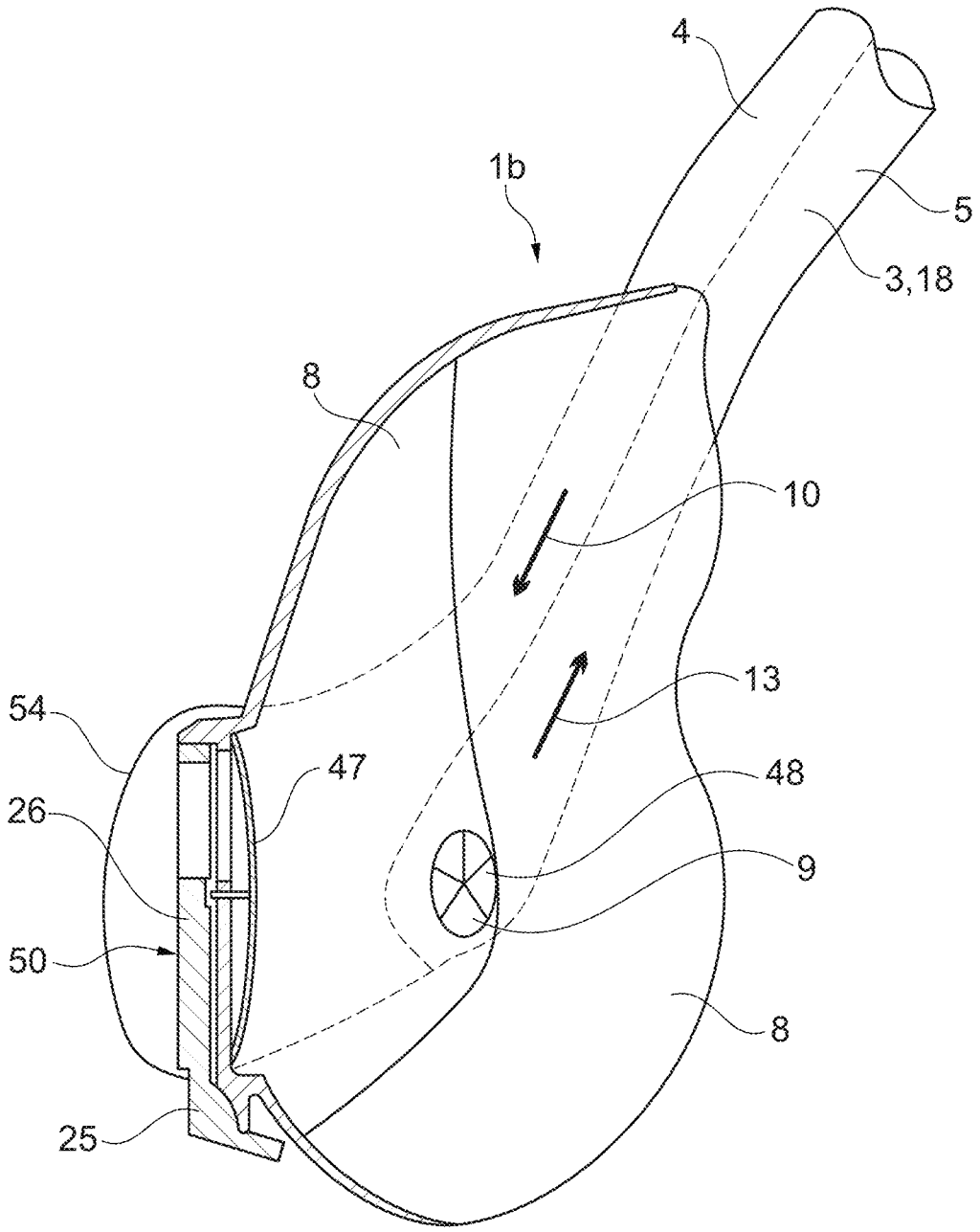

FIG. 15: the illustration of the inside air routing for inhaled air in the region of the channel connector FIG. 16: an interior view of the snorkeling mask illustrating the inhaled air in the half mask FIG. 17: the same illustration as FIG. 16 with an illustration of the air routing for the exhaled air FIG. 18: the illustration of the air routing of the exhaled air in the channel connector FIG. 19: a schematic section through a training mask for dry training with the improved air routing FIG. 20: an embodiment of a snorkel training mask for swim training that is modified in comparison with FIG. 19

Figure 21:
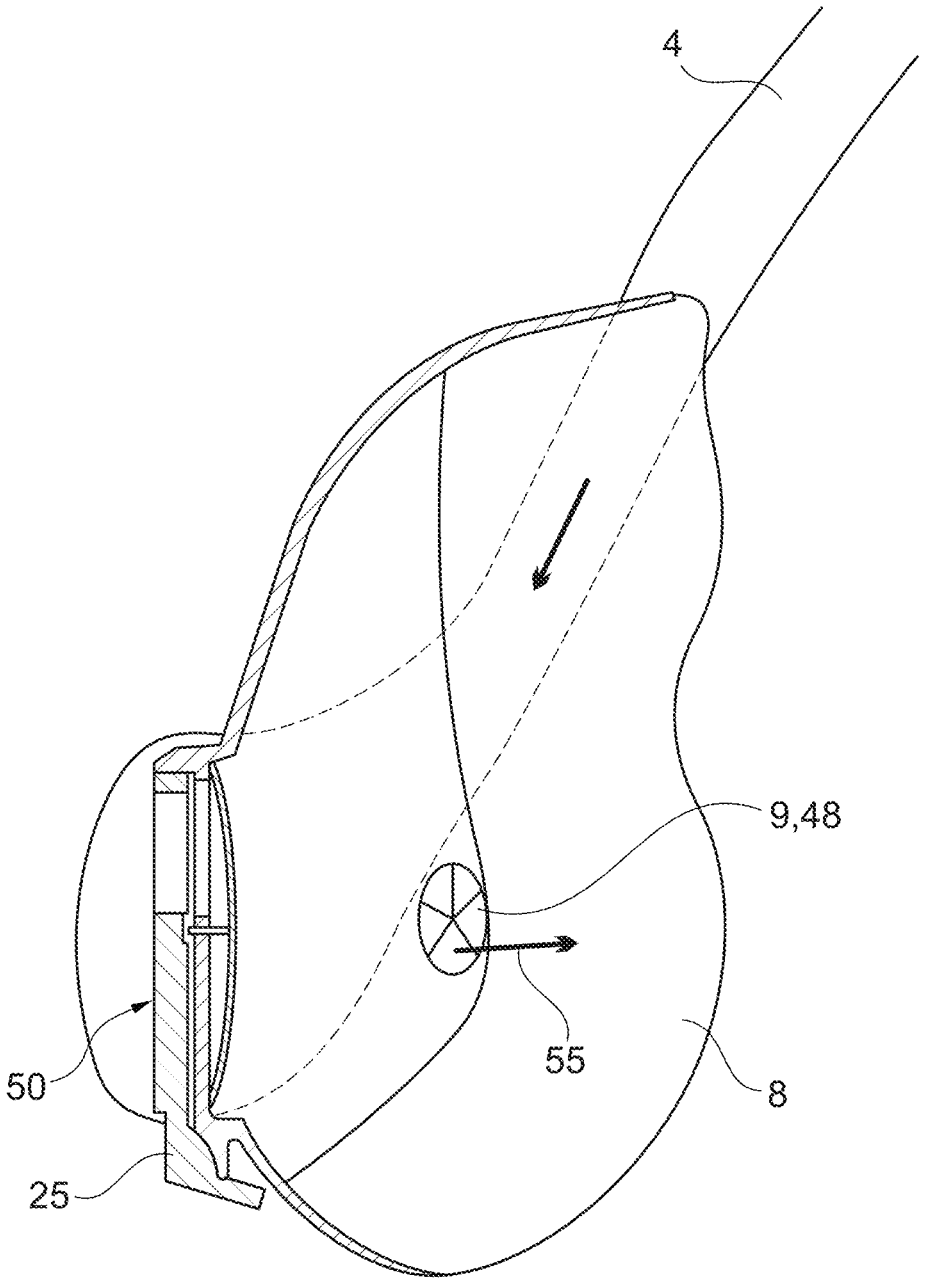
Figure 22:
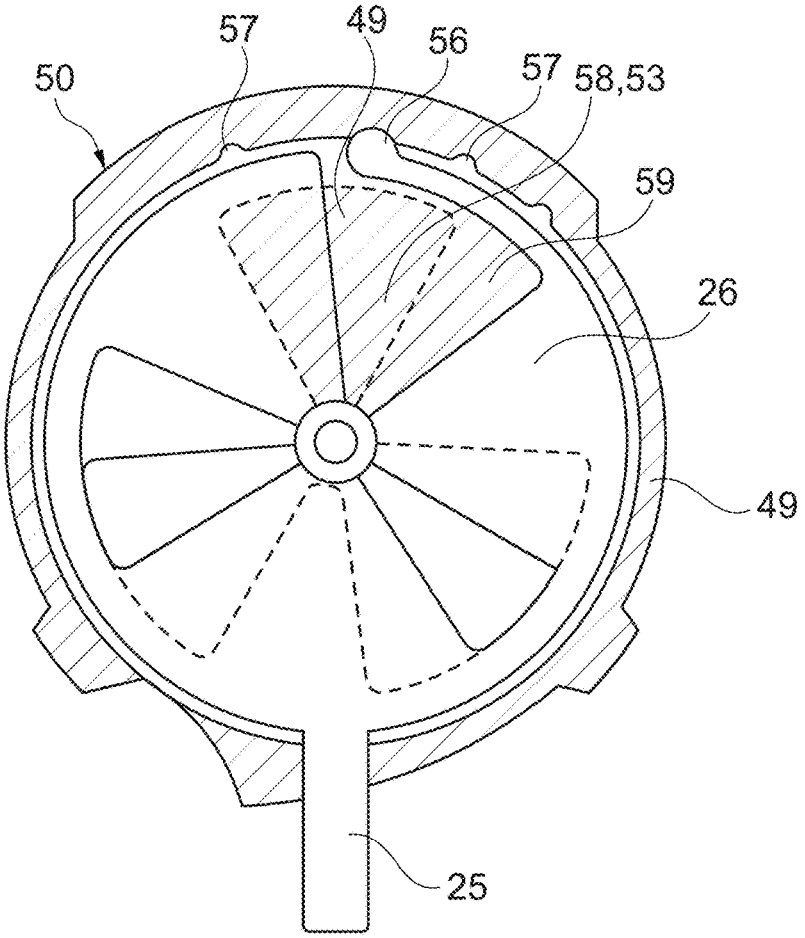
Figure 23:
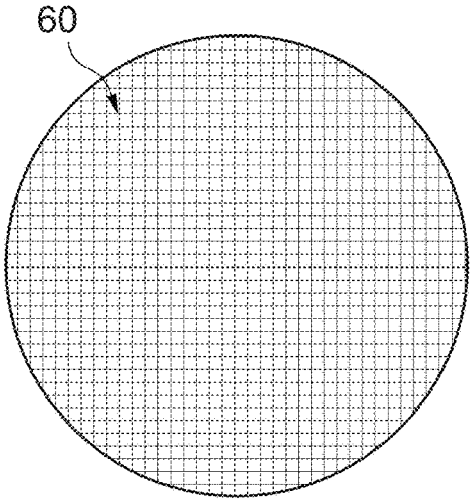
Figure 24:
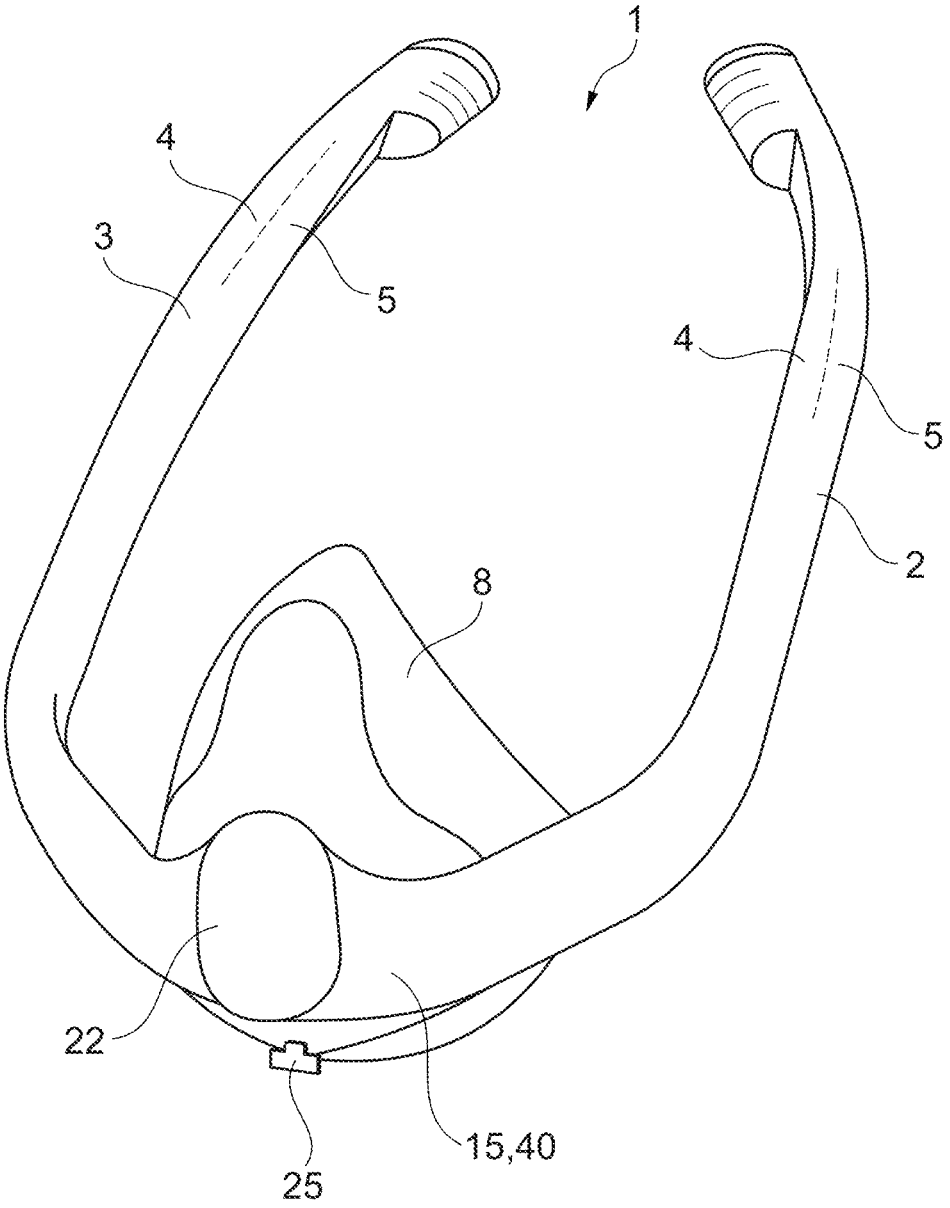
Figure 25:
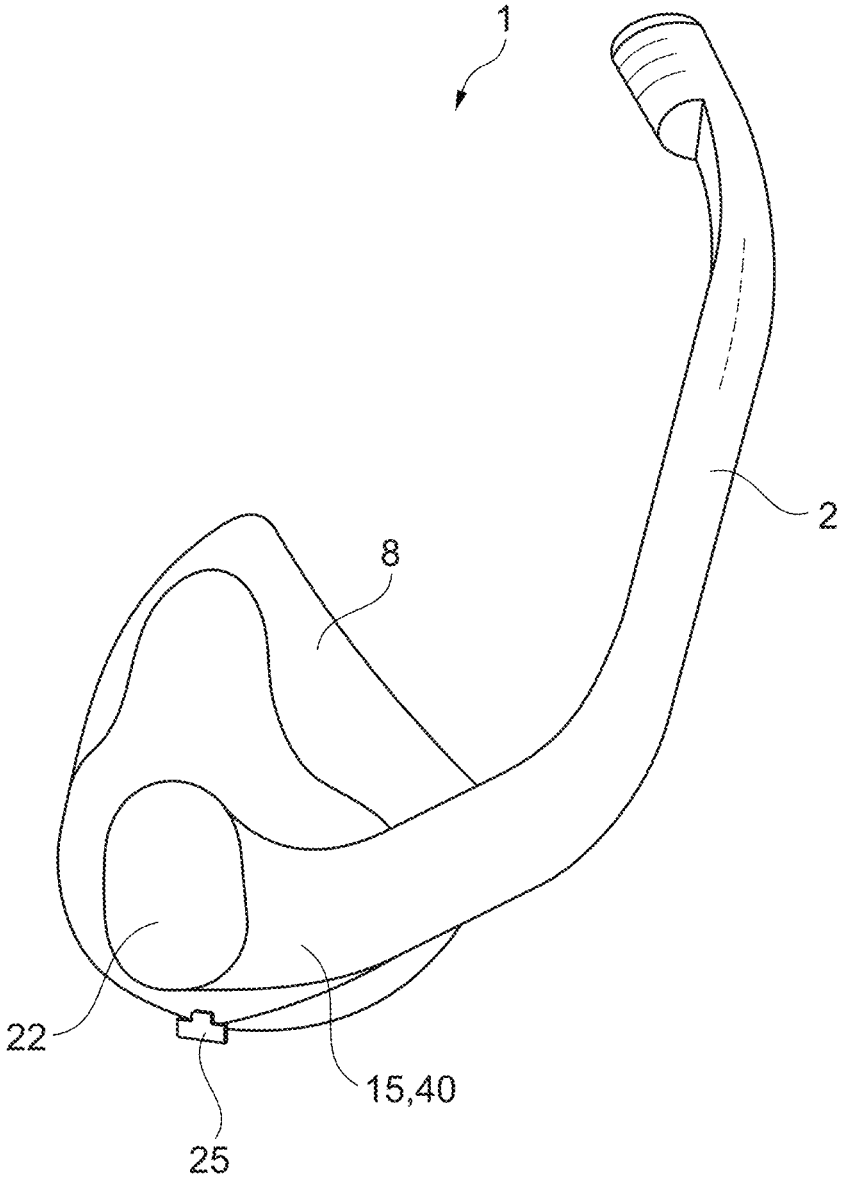
Figure 26:
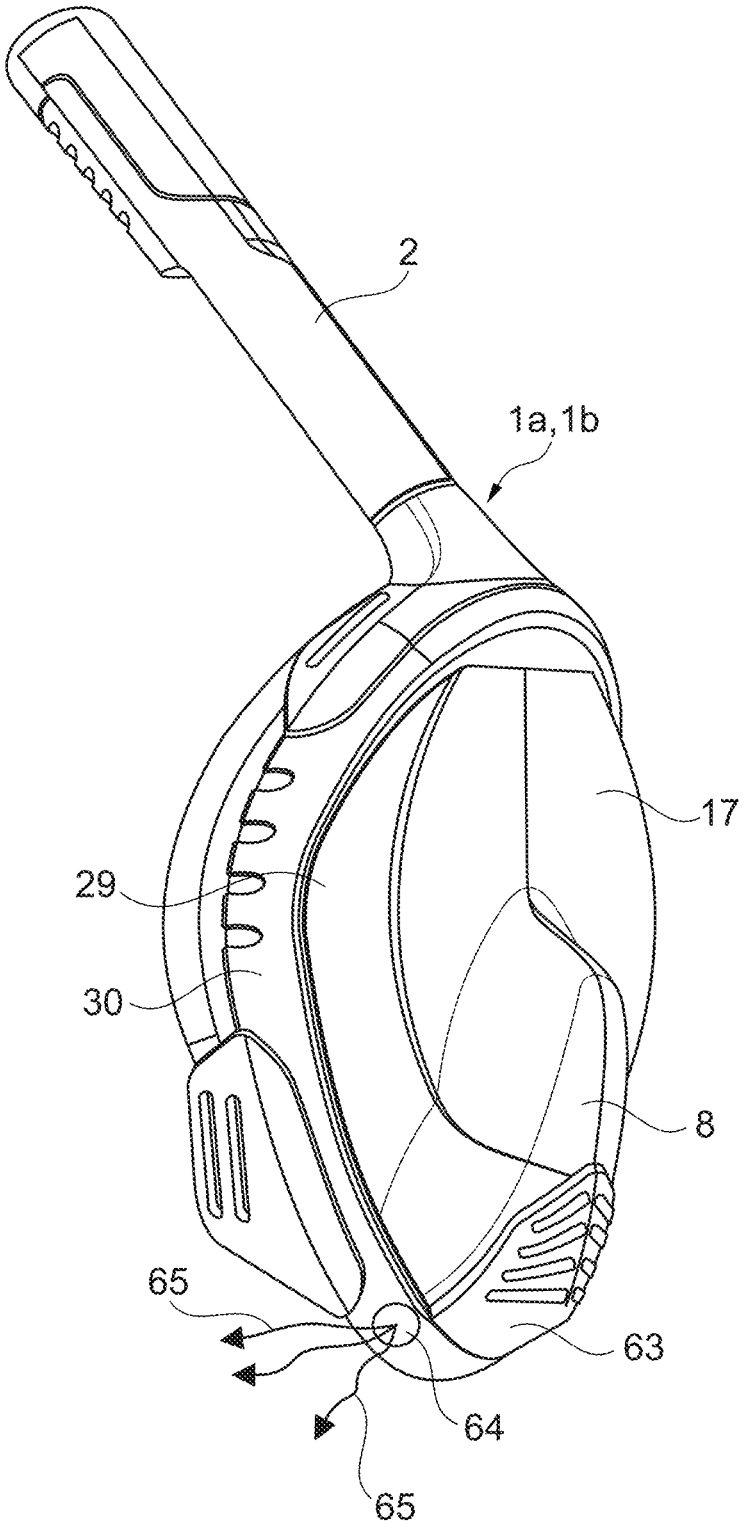

FIG. 21: the same illustration as FIG. 20, but with different discharge mechanics for the discharged air FIG. 22: schematically the plan view of a rotary slide valve of a reducing device for reducing the inhaled air FIG. 23: the illustration of a filter which can be used instead of or with the rotary slide valve in the reducing device in order to generate filtered inhaled air FIG. 24: schematically an illustration similar to FIG. 2 in the design of a snorkel training mask for swim training FIG. 25: a modification of a snorkel training mask in comparison with FIG. 24 with only a single snorkel FIG. 26: a training and/or snorkeling mask with lateral discharge openings for the exhaled air The partial illustration in FIG. 1 is used to schematically explain the air routing in a training mask, it being preferred that both the inlet opening and the outlet opening include valves in order to achieve an aerotechnical separation between the inlet and outlet openings.

The training mask 8 carries a front-side front cap 51, which is provided for design reasons and covers the half mask 8 forwardly, the recess for the inflow opening 22 into the half mask 8 being provided in the front cap 51.

A head strap 24 is also illustrated with which the training mask 1 can be attached to the head.

In this configuration, it is advantageous that the exhaled air is now discharged via the lateral discharge openings 9 to the outside without the discharged flow coming into contact with the inflow air inflowing via the frontal inflow opening 22 and crossing with the latter.

In FIG. 1, the inflow opening 22 arranged behind the throughflow openings 53 in the front cap 51 is only shown schematically because the actual inlet is arranged behind the throughflow openings 53 in the front cap 51 in the half mask 8.

In a further development of the simplified training mask according to FIG. 1, FIG. 2 already shows a training mask 1 which has a half mask 8, which preferably consists of a flexible, compressible plastic material, e.g., a polyurethane or a comparable plastic material.

The half mask 8 sealingly encloses the face and nose region of the wearer and is attached to the wearer's head with head straps 24 (see FIG. 1), not shown in detail, so that inhalation and exhalation can take place only via the interior of the half mask 8.

According to a preferred embodiment of the invention it is provided that a total of two identical snorkels 2, 3 are present, each snorkel having at least one supply air channel 4 and at least one exhaust air channel 5 separated from supply air channel.

Of course, the exemplary embodiment according to FIG. 2 also includes the use of a single snorkel 2 or 3, as illustrated in FIG. 25.

In the exemplary embodiment according to FIGS. 1 and 2, the inhaled air, in the direction of arrow 6, is sucked into the supply air channel 4 of the snorkel 3, and arrives, in the direction of arrow 10, in a connecting part 15 which also connects the opposite supply air channel 4 in the snorkel 2 in an air-tight manner so that supply air from both snorkels 2, 3 and the supply air channels 4 with a high cross section arranged there enters into the connecting part and there flows into an inflow opening 22 which is arranged frontally on the front side 16 of the half mask 8. In a somewhat different embodiment, the connecting part 15 is later also referred to as a channel connector 40. Both parts 15, 40 have the same task, namely to enable the inhalation and exhalation paths to be separated in the region in front of the half mask 8. When using the connecting part 15 or the channel connector 40, this leads in both cases to the particular advantage that the inhaled air can be supplied frontally from the front into the mouth region of the half mask 8.

A large-area poppet valve (later in the configuration described as a reducing device 50) not illustrated in more detail, is arranged behind the inflow opening 22 in order to enable a large volume inflow of inhaled air via the front-side inflow opening 22.

As a further advantageous measure it is provided that the exhaled air is no longer discharged via the front-side inflow opening 22, as is known in the prior art, but now lateral discharge openings 14 are arranged at the half mask 8, through which the discharge air flows out laterally through valves arranged in the discharge openings 14 in the direction of arrow 13. It then reaches the exhaust air channel 5 arranged on both sides and flows out of the two snorkels 2, 3 in the direction of arrow 7.

In a further configuration, not shown in the drawing, however, the valve-supported discharge openings 14 can lead directly into the environment, which means that the exhaled air reaches the water directly via the valve-supported discharge openings 14. In this case, the inhaled air is routed through the supply air channel 4 of the snorkel 2, 3. In this way, the exhaled air is no longer routed into the exhaust air channel 5 of the snorkel 2, 3, but instead is routed directly into the water with shortening the flow path.

If this snorkeling mask is used as a training mask, the exhaled air is discharged into the surrounding air.

As a result, FIG. 2 shows that the inhaled air flowing into the mask in the direction of arrow 11 is now completely separated from the exhaled air because the exhaled air flows out laterally from the half mask 8 through the lateral discharge openings 14, while the inhaled air is routed frontally in the front region at the front side 16 of the half mask 8 directly and without flow obstacles into the mouth and nose region of the user via the connecting part 15 arranged in front of the front side 16 of the half mask 8.

FIG. 3 shows an illustration similar to FIG. 2, only with the difference that the half mask 8 is additionally integrated in a visor 17 sealingly enclosing the entire face, and a snorkeling mask 1*a* is formed from it, which differs only slightly from the half mask 8 according to FIGS. 1 and 2. Such a snorkeling mask 1*a* is therefore suitable as a training mask 1 both for dry training outside of the water and for swim training.

It should also be noted that the rotary slide valve, the handle 25 of which is shown in FIG. 1, can also be omitted because an air-restricting training effect is provided in snorkeling masks 1*a*, 1*b* even without a rotary slide valve.

Accordingly, the snorkeling mask 1*a* in FIG. 3 shows a visor 17, which is transparent, and the two snorkels 2, 3 are provided which each form separated supply air and exhaust air channels 4, 5. The supply air flows in the direction of arrow 10 into the interior of the visor 17 and keeps it fog free. The supply air flows into the half mask 8 through the channels 15, 31, 40, 62 to be described below and is absorbed by the mouth and nose of the user, which is associated with the advantage that with such an arrangement both oral and nasal breathing is possible.

As illustrated earlier, there is a separation of inhaled and exhaled air by the half mask 8 by arranging lateral discharge openings 14 for the exhaled air in the half mask 8, which are illustrated only partially in FIG. 3 and in full in FIG. 4.

The inhaled air reaches lateral transfer openings 20 arranged in the intermediate region between the visor 17 and the half mask 8 via the interior of the visor in the indicated direction of the arrow 10, where it flows in each case on both sides into the entrance region of the connecting part 15 in the direction of arrow 10 and reaches the frontal inflow opening 22 of the half mask 8.

The exhaust air reaches the respective exhaust air channel 5 in the respective snorkel 2, 3 through the discharge openings 14 arranged laterally on the half mask 8—completely separate from the inhaled air—or alternatively via valve-supported discharge openings 14 directly into the environment (water or air)—so that here also there are separate air routing paths.

This also applies to the embodiment according to FIG. 4, where a different form of a snorkeling mask 1*b* is illustrated, which differs from the snorkeling mask 1*a* according to FIG. 3 in that there is a single snorkel, which defines the supply air and exhaust air channels 4, 5 which are separated from one another. Otherwise, the same description applies as for FIGS. 2 and 3.

The supply air thus flows through the supply air channel 4 in the direction of arrow 6 into the interior of the visor 17, and then flows—as explained with reference to FIG. 3—via the transfer openings 20 not shown in FIG. 4 in front-side channel connector 40, which here is formed as connecting part 15, the connecting part 15 being closed in each case in the direction towards the discharge channel by a closure 19 in order to avoid mixing of inhaled and exhaled air.

The exhaled air flows in the direction of arrow 13 through the discharge openings 14 arranged laterally in the half mask 8 into an air channel 23 arranged laterally in the snorkeling mask 1*a*, 1*b*, which can either be integrated into the snorkeling mask on the edge of the face seal or routed as a separate channel in the snorkeling mask.

In the shown exemplary embodiment according to FIGS. 3 and 4, it is discharge air channel which is routed as an internal air channel in the interior of the snorkeling mask 1*a*, 1*b* as a separate air hose.

FIGS. 3 and 4 show that the air can be supplied either via two snorkels 2, 3 (FIG. 3) or via a single snorkel 3 (FIG. 4).

FIG. 5 shows an interior view of a snorkeling mask 1*b* that is formed as a training mask in such a way that the general concept of the invention is realized for all embodiments, namely, an improved air routing of the inhaled and exhaled air.

In the shown embodiment of FIG. 5, the inhaled air coming from snorkel 3 flows into the interior of the mask, i. e. via the inside of the visor 17, and flows in the direction of arrow 10 into associated transfer openings 20, which are integrated in the mask frame 30 of the snorkeling mask 1*b* so as to ensure that the inhaled air flows across large cross-sections into the channel connector 40 arranged in front of the half mask 8 and connected to it, in the direction of the central inflow opening 22.

The discharge openings 9 are separated from the supply opening 22 and are directed laterally outwards in order to avoid mixing of inhaled and exhaled air.

The invention provides two different exemplary embodiments with regard to the snorkeling mask according to 1*b*.

It can be provided that the discharge openings 9 and the transfer openings 20 are closed with suitable poppet valves in order to achieve forced inhalation when the exhalation openings are closed and, conversely, a closure of the inhalation openings when the exhalation opening discharges discharge air.

In another configuration, however, these valves in the region of the transfer openings 20, 22 may be omitted, because the separation of the air passages is built into the snorkel, i. e., via the valve device 25 on the snorkel end. The snorkel 2, 3 then only carries either inhaled air or exhaled air, so that the openings 20, 22 with valves in the snorkeling mask 1*b* itself can be dispensed with. The valves can be positioned in the snorkel.

In any case, the inhaled air flows in the direction of arrow 10 across the inside of the visor 17 and keeps it fog free.

Starting from the discharge openings 9, the exhaled air is introduced into frame-side exhaust ducts 5 and from there into the exhaust air channel 5 in the respective snorkel 2, 3.

FIG. 6 schematically shows the structure of a snorkeling mask 1*b* according to FIG. 5, where it can be seen that a total of three essential parts are present, namely a visor 17, which is sealingly inserted into the mask frame 30 and also a half mask 8, which is connected to a face seal 29, with the face seal 29 being sealingly inserted into the mask frame 30.

It is illustrated here that the inhaled air flows through the inner cross section of the snorkeling mask (mask frame 30) in the direction of arrow 10 and reaches the half mask 8.

FIG. 6 also illustrates the central, frontal inflow opening 22 for the inhaled air and the lateral discharge openings 9 arranged on both sides of the half mask 8.

FIG. 6 also illustrates an alternative embodiment of the air routing of the exhaled air. Instead of routing the exhaled air—as described above—through exhaust air channels 5 arranged edge-side in the mask frame 30 into the snorkel, the alternative in FIG. 6 shows a graphic illustration of lateral discharge openings 64 arranged in the channel connector 40, so that the exhaust air channels 5 can be omitted and instead, valve-supported lateral discharge openings 64 are arranged in the channel connector 40 through which the exhaled air can pass into the environment. This is also illustrated in FIG. 26.

The discharge openings 64 (in FIGS. 6 and 26) are valve-supported in order to avoid that water undesirably passes through the outlet opening 64 in the half mask when discharging the flow of exhaled air into the water.

It is assumed in this case, that the discharge openings 9 in the half mask 8 are connected to the lateral valve-supported discharge openings 64 in the channel connector 40 in an air-tight manner.

By avoiding a long path for the exhaled air via the exhaust air channels 5 shown in FIG. 6, according to the alternative embodiment, a significantly shorter outflow length for the exhaled air via the discharge openings 64 is achieved.

FIG. 7, in comparison with FIG. 6, shows the interior view of the half mask 8, together with an interior view of the snorkeling mask 1*b* where it can be seen that the central inflow opening 22 is arranged in an air-tight manner separated from the discharge openings 9 for the exhaled air laterally outgoing therefrom, and the inhaled air, starting from the interior of the visor 17, is passed via the lateral transfer openings 20 through the central channel connector 40, which is integrated in the mask frame 30.

Here, too, it is illustrated that the exhaust air, the exhaled air, is routed into the snorkel 3 via a frame-side exhaust air duct 5.

FIG. 8 schematically shows the routing of the inhaled air in the channel connector 40, which is only indicated schematically, where it can be seen that the inhaled air flows in the direction of arrow 10 into the lateral transfer openings 20 and is introduced there via tube-like or cavity-shaped connecting pieces 31 on both sides into the central, frontal inflow opening 22 of the half mask 8 in the direction of arrow 38.

This results in a particularly streamlined supply of the inhaled air from the interior of the visor 17 via a channel connector 40 arranged frontally in front of the half mask 8, which passes the inhaled and exhaled air via separated air routing paths 31, 62.

The channel connector 40, which is fluidically generously sized, has only a slight redirection of flow and uses large flow cross sections resulting from the large volume of the connecting pieces 31, 62.

For comparison, in the prior art the inhaled air is passed directly onto the nose in the direction of arrow 10, which presupposes the inhaled air be deflected at the nose of the user, in order to enter the nostrils, while in the present case the inhaled air is introduced directly frontally from the front into the mouth region in the half mask 8 via the central inflow opening 22, as a result of which there are significantly lower flow resistances.

Compared to the prior art, the snorkeling mask 1*b* illustrated is characterized in that a direct frontal supply of the inhaled air into the half mask 8 takes place into the mouth region and not—as in the prior art—only into the nose region, where the air must be deflected and flows into the nose with reduced cross section.

Analogously, FIG. 9 shows the routing of the exhaled air out of the half mask 8, where it can be seen that there are now discharge openings 9 in the half mask 8 to the side of the central inflow opening 22, in which the discharge air flows in the channel connector 40 which is illustrated only schematically, in the direction of arrow 34. The air-conducting connecting pieces 62 arranged in the half mask 8 in the region of the channel connector 40 are merely indicated, in order to illustrate their function graphically.

FIGS. 8 and 9 thus show merely schematically the routing of the inhaled and the exhaled air, wherein a channel connector 40 with its air-routing connecting pieces 31, 62, which channel connector 40 will be described in the drawings below, is merely indicated and in reality includes the flow paths illustrated hatched in FIGS. 8 and 9 as the connecting pieces 31, 62, and separates them aerotechnically from each other.

FIG. 9 also shows that at the exit (of the schematically illustrated channel connector 40) the exhaled air flows through a connection opening 32 on the snorkeling mask side in the direction of arrow 34, which connection opening 32 is connected in an air-tight manner with a discharge channel 36 arranged on the face seal 29, through discharge channel 36 the discharge air is routed along the mask frame 30 in the direction of the one or more exhaust air channels 5 in the snorkel 2, 3, 18.

FIG. 10 now shows the channel connector 40 which has previously already been described with respect to its function, which serves a separate routing of the discharge and the inhaled air and which may be formed either as a flexible elastomeric channel part or as a solid piece of tube, which connects a central part 42 with two mutually parallel extension pieces 41.

The two extension pieces 41 with hollow profile route the air channels previously mentioned for the inhaled and exhaled air, and the connection tubes 43 are connected to the mask frame 30 via the transfer openings 20, so that the inhaled air is routed through the large hollow cross sections of the channel connector 40. The inhaled air is introduced into the central inflow opening 22 in the front region of the half mask 8 via the front-side, generously sized central part 42. In this way, the inhaled air went directly into the mouth and nose region of the user.

As a preferred further embodiment, FIG. 10 shows that the half mask 8 can have a front-side flexible, approximately U-shaped profiled nose piece 37, so that for the first time there is the possibility of pressure equalization under water.

By applying finger pressure to the flexible nose piece 37 the user can compress the nose behind said nose piece 37 in order to exhale against the closure of the nose from the mouth and to introduce the exhaled air into the interior of the snorkeling mask in order to reduce the overpressure prevailing in the interior of the snorkeling mask arising from the pressure of the water column. In doing so, a pressure equalization can be effected when diving with the snorkeling mask when the water column bearing down on the snorkeling mask from the outside of the snorkeling mask presses the snorkeling mask too strong against the head region of the user.

In a variant embodiment, it may be provided that the connection tubes 43 of the channel connector 40 for routing the exhaled air do not open into the mask frame 30, but are introduced in the face seal 29 or in the visor 17.

FIG. 11 shows an exploded illustration of the drawing according to FIG. 10, where the various connection parts for the inhaled and exhaled air in the channel connector 40 are also illustrated.

The connection tubes 45 for the exhaled air are illustrated, which open into exhaust air channels 5 arranged in the mask frame 30, the tube 45 being connected to the connection opening 32 in an air-tight manner, which connection opening 32 is arranged in the intermediate space between the mask frame 30 and the face seal 29.

The exhaust air channel 5 can, however, also be integrated in the mask frame 30 itself or in the face seal 29 or in the visor 17.

FIG. 11 also shows that lateral connection openings 61 are present at the channel connector 40, which are connected to the half mask-side discharge openings 9.

The discharge air flowing out of the half mask 8 leaves said half mask 8 through the discharge openings 9 in the half mask 8, the connection openings 61 being arranged in the interior of the channel connector 40 and connected to the connection tubes 45 described above in an air-tight manner which connection tubes 45 in turn are connected to the exhaust air channel 5 via the connection openings 32.

FIG. 12 shows the assembled arrangement according to FIGS. 10 and 11 and also shows an additional water drainage valve 44, which is arranged as a simple outlet opening with a valve in the central part of the channel connector 40.

Water accumulating in the channel connector 40 is discharged to the outside by gravity when the swimmer lifts his head from the water.

The water drainage valve 44 is valve-supported, i. e. water cannot penetrate from the outside, but can flow to the outside from the interior of the central part 42 due to gravity.

FIG. 12 also shows the flexible nose piece 37 with a U-shaped profile, with which in the case of a full face mask according to the previous illustrations, pressure equalization by compressing the nasal bridge is possible, which was previously not possible with full face masks because they did not have compressible, elastic elements.

FIG. 13 shows the interior view of the arrangement according to FIG. 12, where in particular the two exhaust air channels 5 are shown and both channels open into the snorkel 3, 18. In this case, the exhaust air is discharged via a valve in the snorkel.

FIG. 13 also shows the routing of the inhaled air in the direction of arrow 6 through the supply air channel 4 in the snorkel 3, 18, which inhaled air flows across the face-side surface of the visor 17 and reaches the channel connector 40 in the lateral inflow openings mentioned above and the transfer openings 20 mentioned above.

FIG. 14 shows the side view of FIG. 13, the same reference numerals being used for the same parts. The inhaled air flowing in the direction of the arrow 10 on the inside of the visor 17 reaches the lateral transfer openings 20 in the region of the mask frame 30 and flows into the channel connector 40.

FIG. 15 shows the same illustration as FIG. 14 illustrating the routing of the breathing air which is deflected from the transfer opening 20 in the direction of arrow 38 in the central part 42 of channel connector 40 and flows directly frontally to the mouth region of the user via the inflow opening 22 in the half mask 8.

FIG. 16 shows the same illustration as before, illustrating the interior view of the snorkeling mask 1*b* where it can be seen that the half mask 8 on the inside has a peripheral sealing bead 39, so the half mask 8 sealingly abuts the mouth and nose region of the user.

Here, it is shown that, starting from the central inflow opening 22, the air is passing directly into the mouth and nose region of the user in the directions of arrows 46. This results in particularly low flow resistances.

FIG. 16 also shows that the two exhaust air channels 5 can be embedded in the face seal 29.

FIG. 17 shows the routing of the exhaled air via the lateral discharge openings 9 arranged in the half mask 8, which exhaled air is introduced into the lateral exhaust air channels 5 in the manner described above via air-routing channels in the channel connector 40 and connection openings 32.

FIG. 18 shows the routing of the discharge air in comparison to FIG. 17, where it can be seen that the discharge openings 9 are arranged in the channel connector 40, in the interior of which the discharge air separated from the inhaled air is routed into edge-side connection openings 32 which are connected to the adjacent exhaust channels 5 in an air-tight manner.

As far as the above description refers to snorkeling masks 1*a*, 1*b* which are suitable for swim training, it should be noted that a reducing device 50 may be arranged in such snorkeling masks 1, 1*a*, 1*b* and, as will be explained with reference to FIGS. 19-25 below.

Thus, a double benefit results from the use of snorkeling masks 1, 1*a*, 1*b*, for a training effect of the respiratory muscles is already achieved by the air-flow paths of a snorkeling mask 1*a*, 1*b* having a restricted cross section, without requiring the installation of a special reducing device 50.

An extended training effect is achieved, however, when a reducing device 50 corresponding to the figures below is installed in a snorkeling mask 1, 1*a*, 1*b* according to the previously described embodiments, for example, in the region of the inflow opening 22 of the half mask 8. Therefore, the invention claims, inter alia, this particular configuration as being preferred.

FIG. 19 shows a training mask for dry training of the type illustrated in FIG. 1.

It follows that such training mask according to FIGS. 1 and 19 can be used alone for the dry training or can be used in combination with a snorkel for the swim training.

The training mask 1 illustrated in FIG. 19 for dry training accordingly has a half mask 8, which surrounds the mouth and nose region of the user, and the previously described outlet openings 9 are present laterally in the half mask, which are closed by a poppet valve 48 in the exemplary embodiment shown, so that only the exhaust air escapes there, but no inhaled air can enter.

The front side of the half mask 8 is formed by a reducing device 50 with which a supply of the inhaled air can be reduced, the reducing device essentially consisting of a bridge part 49 fixed to the housing, on which a generously sized poppet valve 47 is arranged in the region of a pivot bearing 52, which poppet valve ensures that only inhaled air can enter via the central air inflow opening 22, but that no discharge air can escape there.

The reducing device 50 is also formed by a rotary slide valve 26 which is approximately disk-shaped and is rotatably supported in a pivot bearing 52, the rotary slide valve having a handle 25 on one side for its rotary actuation.

The front side of the reducing device 50 is covered by a front cap 51 in which a plurality of throughflow openings 53 is arranged.

FIG. 20 shows the application of the training mask according to FIG. 19 for swim training, wherein at least one snorkel 3, 18 can be used, in which two separate channels 4, 5 are arranged for the supply air and exhaust air, because the supply air is connected to the front side of the half mask 8 in an air-tight manner in the direction of arrow 10, and the exhaust air passes through the discharge openings 9 arranged laterally on the half mask 8 passing the poppet valve 48 arranged there into the exhaust channel in the direction of arrow 13.

This system can also be used without the reducing device 50 mentioned and offers to the swimmer the advantage that he also has nasal breathing at his disposal without having to rely on the operation of the reducing device 50.

The figures according to FIGS. 19, 20 and 21 also show that there is also the possibility of installing a filter 60 instead of the rotary slide valve 26 of the reducing device 50, so that purified inhaled air is generated which the user can inhale directly.

This means that the reducing device 50 can work with a rotary slide valve 26 and additionally with a filter 60 placed in front of it, or only on its own if the rotary slide valve 26 is omitted and only a filter 60 is present.

This results in the possibility of using a training mask 1 according to FIG. 19 with and without a reducing device 50 and, furthermore, according to FIG. 20, also using such a training mask 1*b* with or without a reducing device 50 and with or without a filter 60.

In contrast to FIG. 20, FIG. 21 shows that it is not necessary for the solution to arrange for the exhaled air flow to be discharged through the snorkel 3, 18 itself.

FIG. 21 shows, therefore, that the discharge openings 9 serving the discharge air, which are closed by a poppet valve 48, can release the discharge flow directly into the environment in direction of arrow 55. Such an arrangement is also suitable for both dry training and swim training.

FIG. 22 shows schematically a plan view of the reducing device 50 where it can be seen that a plurality of throughflow openings 53 arranged to be distributed uniformly on the periphery in the stationary bridge part 49 are present which can be closed by valve sheet- or wing-like closure cross sections of the rotary slide valve 26. Depending on the rotational position of the rotary valve 26 that is formed to latch, more or less closed throughflow openings 53 result for the breathing air.

In the exemplary embodiment shown, air flows through the free cross section 58, while the laterally adjoining parts are closed by the valve sheets of the rotary slide valve 26 as closure openings 59. In this way, only a certain part of the throughflow opening 53 is released.

The rotary slide valve 26 has a radially outwardly directed, resiliently designed latching hook 56 which can be brought into engagement in associated latching recesses 57 fixed to the housing in order to fix a specific latching position of the rotary slide valve 26.

FIG. 23 shows a filter which can either be inserted into the reducing device 50 or which can be used instead of the rotary slide valve 26.

In accordance with the exemplary embodiment according to FIG. 1 and the description there, FIGS. 24 and 25 each show a training mask 1 for swim training, with only the interior of the half mask 8 being air-tightly connected to the snorkels 2, 3 described above for swim training, thus providing a separate routing of the inhaled and exhaled air in the supply and exhaust air channels 4, 5 of the snorkels 2, 3 via the channel connector 15, 40 described.

In FIG. 24, the handle 25 for the reducing device 50 (not illustrated in more detail) is shown at the bottom of the half mask 8.

In a modification of the exemplary embodiment according to FIG. 24, FIG. 25 shows that only a single snorkel 2 can be present in order to accomplish swim training with reduced inhaled air using the reducing device 50.

The half mask 8 sealingly extends over the nose and the mouth of the user in order to enable combined oral and nasal breathing. In another configuration, a downsized half mask may extend only over the mouth portion and the nasal wings are closed by a conventional nose clamp, so that in this case, the training mask is for oral breathing only.

FIG. 26 shows—in comparison to FIG. 6—a further embodiment of the discharging of the exhaled air via discharge openings 64 drawn there.

The mask frame 30 carries a front cover 63.

In the alternative shown in FIG. 6 with discharge openings 64 in the channel connector 40, FIG. 26 shows that such discharge openings 64 do not necessarily have to be arranged in a channel connector 40. They can be arranged directly on or in the mask frame 30 or on or in the visor 17 in order to enable that, instead of routing the exhaled air through long discharge channels 5 into the snorkel 2, 3, it is now ensured that the exhaled air can be discharged from the half mask 8 in the direction of arrow 65 directly into discharge openings 64 arranged laterally on mask frame 30. In this first configuration, the valve-supported discharge openings 64 are arranged laterally on the mask frame and/or the visor 17. In a second configuration—not shown in the drawing—one or more discharge openings 64 can be arranged at the bottom and in the center of the visor 17 and/or on the mask frame.

Accordingly, the advantage of the training mask 1, 1*a*, 1*b* according to the various exemplary embodiments is that there is a simple design with direct flow paths and that it can optionally be designed as a dry training mask or as a wet training mask (snorkeling mask). A crossing and mixing of the inhaled and exhaled air in the region in front of the half mask 8 is avoided in all configurations. The inhaled air is supplied from the front frontally in the mouth region of the user, and therefore there is the possibility to create a snorkeling mask or training mask, which is suitable both for dry training as well as for swim training.

LIST OF REFERENCE NUMERALS

1 training mask
- 1*a* snorkeling mask
- 1*b* snorkeling mask

2 snorkel
3 snorkel
4 supply air channel
5 exhaust air channel
6 direction of arrow
7 direction of arrow
8 half mask
9 discharge opening (in 8)
10 direction of arrow
11 direction of arrow
13 direction of arrow
14 discharge opening
15 connecting part (see channel connector 40)
16 front side
17 visor
18 snorkel
19 closure
20 transfer opening
21 direction of arrow
22 inflow opening
23 discharge air channel
24 head strap
25 handle (of 26)
26 rotary slide valve
27 valve device
28 receptacle opening
29 face seal
30 mask frame
31 connecting piece
32 connection opening (discharge)
33 direction of arrow
34 direction of arrow
35 direction of arrow
36 discharge channel (in 29)
37 flexible nose piece
38 direction of arrow (inhaling)
39 sealing bead (of 8)
40 channel connectors
41 extension piece
42 central part
43 connection tube (inhaling)
44 water drain valve
45 connection tube (exhaling)
46 direction of arrow (inhaling)
47 poppet valve (inhaling)
48 poppet valve (exhaling)
49 bridge part (of 8)
50 reducing device
51 front cap
52 pivot bearing
53 throughflow openings
54 snorkel distributors
55 direction of arrow
56 latching hook
57 latching recess
58 free cross section
59 closure opening
60 filter
61 connection opening (exhaling)
62 connecting piece (exhaling)
63 cover
64 discharge opening (in 1*a*, 1*b*)
65 direction of arrow

The invention claimed is:

1. A training and/or snorkeling mask with improved air routing of inhaled and/or exhaled air comprising a half mask configured to sealingly close a mouth and nose area, in which the inhaled air flows through at least one snorkel into an interior of the snorkeling mask into the half mask connected to a face seal, and the exhaled air is dischargeable from the half mask via discharge openings situated in the half mask, wherein an air-conducting channel connector with hollow profile, which said air-conducting channel connector connects two opposing supply air channels or transfer openings to one another, via which the inhaled air flows into the channel connector, is arranged in front of the half mask, via which said air-conducting channel connector at least the inhaled air is frontally introducible in the half mask via a central inflow opening.

2. The training and/or snorkeling mask according to claim 1, characterized in that at least one valve-supported discharge opening is arranged at the channel connector and/or at a mask frame, through which the exhaled air can be expelled directly into the environment.

3. The training and/or snorkeling mask according to claim 1, characterized in that the half mask has one or two diametrically opposite, lateral discharge openings.

4. The training and/or snorkeling mask according to claim 1, characterized in that the central inflow opening and/or the discharge openings of the half mask are formed with valve support.

5. The training and/or snorkeling mask according to claim 1, characterized in that the inflow and discharge openings in the half mask are valve-free and that an associated valve is positioned in the at least one snorkel.

6. The training and/or snorkeling mask according to claim 1, characterized in that the half mask is formed to be flexible and compressible at least in the nose area via a nose piece arranged there.

7. The training and/or snorkeling mask according to claim 1, characterized in that the air-conducting channel connector connects the two opposite air inlet openings air-tightly to one another via connecting pieces and that air outlet openings in the half mask are also air-tightly connected to one another via connecting pieces.

8. The training and/or snorkeling mask according to claim 7, characterized in that the channel connector is air-tightly connected to air-conducting connections of the half mask and/or a mask frame via connection tubes.

9. The training and/or snorkeling mask according to claim 1, characterized in that the channel connector is detachably connected to the half mask.

10. The training and/or snorkeling mask according to claim 1, characterized in that a valve-supported water drainage valve is arranged in the channel connector.

11. The training and/or snorkeling mask according to claim 1, characterized in that exhaust air channels running on both sides in a mask frame are embedded in a face seal of the mask frame.

12. The training and/or snorkeling mask according to claim 11, characterized in that the exhaust air channels are formed as closed tubes.

13. The training and/or snorkeling mask according to claim 1, characterized in that a breathing air-reducing reducing device is arranged in the area of the central inflow opening of the half mask.

14. The training and/or snorkeling mask according to claim 13, characterized in that a poppet valve is arranged in the reducing device.

15. The training and/or snorkeling mask according to claim 13, characterized in that a filter is arranged in the area of the central inflow opening of the half mask.

* * * * *